US012467356B2

(12) United States Patent
Twynam et al.

(10) Patent No.: US 12,467,356 B2
(45) Date of Patent: Nov. 11, 2025

(54) TOP-MOUNTED MUD-TELEMETRY PULSER ASSEMBLY FOR DOWNHOLE COMMUNICATIONS, AND DOWNHOLE VALVE

(71) Applicant: VERTEX DOWNHOLE TECHNOLOGIES INC., Calgary (CA)

(72) Inventors: Kyle Twynam, Calgary (CA); Jaroslav Dobos, Calgary (CA); Carl Brown, Calgary (CA)

(73) Assignee: VERTEX DOWNHOLE TECHNOLOGIES INC., Calgary (CA)

( * ) Notice: Subject to any disclaimer, the term of this patent is extended or adjusted under 35 U.S.C. 154(b) by 12 days.

(21) Appl. No.: 17/613,856

(22) PCT Filed: Jul. 7, 2021

(86) PCT No.: PCT/CA2021/050928
§ 371 (c)(1),
(2) Date: Nov. 23, 2021

(87) PCT Pub. No.: WO2022/094691
PCT Pub. Date: May 12, 2022

(65) Prior Publication Data

US 2023/0313677 A1 Oct. 5, 2023

Related U.S. Application Data

(60) Provisional application No. 63/111,529, filed on Nov. 9, 2020.

(51) Int. Cl.
*E21B 47/24* (2012.01)

(52) U.S. Cl.
CPC ..... *E21B 47/24* (2020.05)

(58) Field of Classification Search
None
See application file for complete search history.

(56) References Cited

U.S. PATENT DOCUMENTS 5,586,084 A 12/1996 Barron et al.
2004/0160060 A1* 8/2004 Montgomery ..... F03B 13/26 290/11

(Continued)

FOREIGN PATENT DOCUMENTS

CA 2879026 C 2/2018
WO WO-0109537 A1 * 2/2001 ..... F15B 13/01

OTHER PUBLICATIONS

WO2001009537—Valve Device—Machine Translation (Year: 2001).*

(Continued)

*Primary Examiner* — Carlos Garcia
(74) *Attorney, Agent, or Firm* — Holzer Patel Drennan

(57) ABSTRACT

A mud pulser for generating pulses in a fluid flow in a wellbore. The mud pulser has a valve housing having an uphole opening for receiving fluid flow, and a piston valve situated in a piston chamber is longitudinally moveable between an open and closed position by closing and opening a pilot port downhole of the uphole opening and in fluid communication with the piston chamber. A first channel extends in the sidewall of the valve housing and fluidly connects the uphole opening and the pilot port. One or more fluid egress ports are in communication with the piston chamber. A metering orifice may be inserted in said one or more fluid egress ports for first channel. Opening and closing the downhole pilot port moves the piston valve and thus opens and closes the uphole opening thereby generating pressure pulses in the fluid flow. A downhole valve is further disclosed.

16 Claims, 33 Drawing Sheets

(56) References Cited

U.S. PATENT DOCUMENTS

| | | | | |
|---|---|---|---|---|
| 2005/0094362 | A1* | 5/2005 | Stephens | H04N 5/65 348/E5.131 |
| 2010/0192295 | A1* | 8/2010 | Fima | E03D 13/00 4/679 |
| 2014/0124693 | A1 | 5/2014 | Gopalan et al. | |
| 2019/0368343 | A1 | 12/2019 | Gopalan | |
| 2020/0199939 | A1 | 6/2020 | Anderson et al. | |
| 2021/0079759 | A1* | 3/2021 | Benson | E21B 43/14 |
| 2023/0313677 | A1* | 10/2023 | Twynam | E21B 47/18 367/83 |

OTHER PUBLICATIONS

PCT International Search Report and Written Opinion of the International Searching Authority mailed Oct. 5, 2021.
Canadian Patent Application No. 3140240 Office Action dated Jan. 17, 2023.

* cited by examiner

FIG. 37
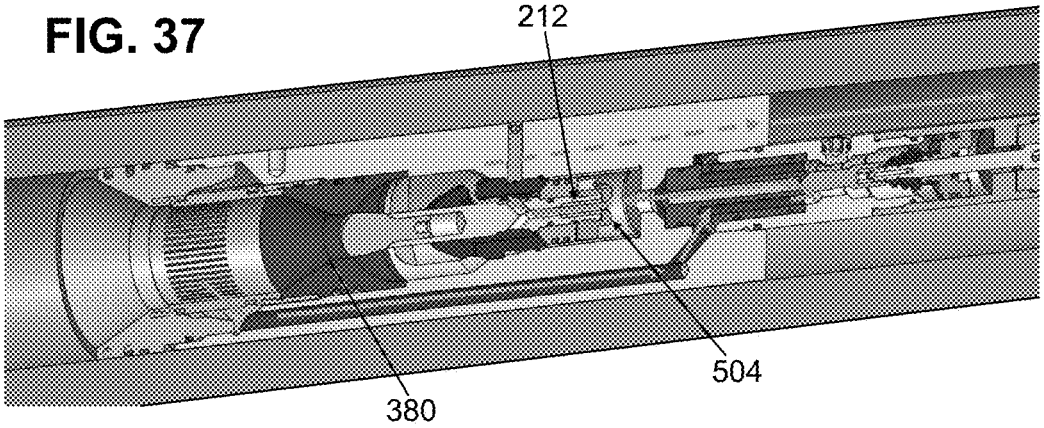
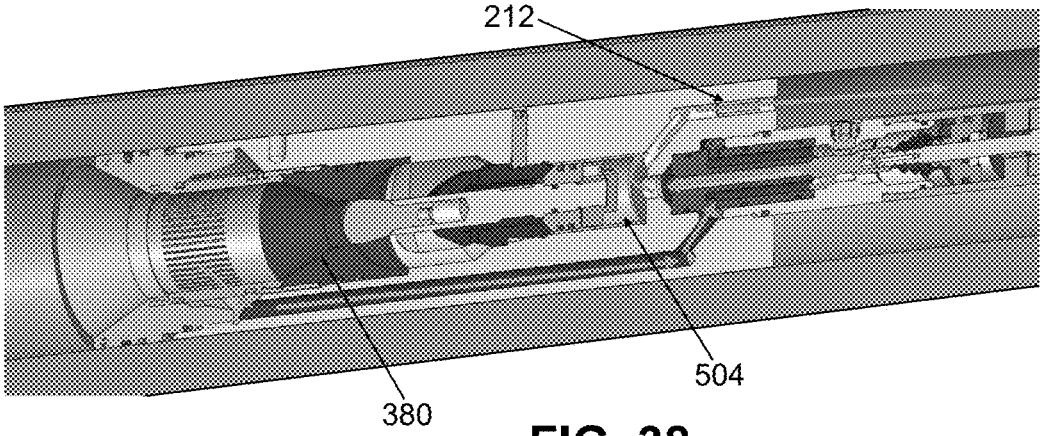
FIG. 38

TOP-MOUNTED MUD-TELEMETRY PULSER ASSEMBLY FOR DOWNHOLE COMMUNICATIONS, AND DOWNHOLE VALVE

FIELD OF THE DISCLOSURE

The present disclosure relates generally to a downhole mud pulser, and in particular to a mud-telemetry pulser for communications between downhole and the surface using pressure pulses, which is adapted for mounting uphole of (as opposed to typically downhole of) a servo-pilot valve.

BACKGROUND OF THE INVENTION

In oil and gas industries, it is often required to transmit data collected by sensors downhole to the surface during a drilling process. Such a downhole-surface communication may be performed via an electromagnetic (EM) telemetry tool using an EM signal propagating through the formation or the drill casing or drill tubing.

The downhole-to-surface communication may also be performed via using a mud-telemetry pulser assembly to create pressure pulses in a fluid column (also known as a drilling mud column), which pressure pulses can be made in a particular duration and sequence and thereby encoded with data.

For example, U.S. Pat. No. 5,586,084 to Barron, et al. teaches a poppet and orifice mud pulser assembly for use in a measurement-while-drilling (MWD) system. The mud pulser is capable of generating pressure pulses in the column of drilling mud of various amplitudes to increase the data rate of the mud pulse telemetry system. The mud pulser includes a piston assembly that positions the poppet with respect to the orifice. The piston assembly comprises part of a by-pass conduit which defines a mud flow path around the orifice. Mud flow in the piston assembly generates a force tending to shut the poppet, because the surface area of the piston is greater than the surface area of the poppet. Mud flow through the conduit (and thus through the piston) tends to force the poppet into a closed position because the force on the piston is greater than the force on the poppet, because of the greater surface area of the piston. A pilot valve is provided to enable and disable flow through the conduit, thus allowing the poppet to open and close. Other amplitude level signals are generated by permitting the poppet to partially open through the implementation of a plurality of parallel pressure relief valves, each of which is set with a different pressure relief value. The pressure relief valves are selected by an associated selector valve. Selection of a pressure relief valve prevents pressure within the piston from exceeding the pressure relief valve, which causes the poppet to partially open, thereby changing the pressure pulse amplitude generated. Alternatively, a motor operated pressure control valve may be used to vary the amplitude of the pressure pulse, thereby permitting the generation of waveforms of any shape.

US Patent Application Publication No. 2014/0124693 A1 to Gopalan, et al. entitled "Rotary Servo Pulser and Method of Using the Same" teaches a servo pulser in a drilling tool for actuating a pulser valve and create pressure pulses in downhole measurement. An electric gearmotor is used to rotate a shaft which in turn operates a servo valve. A facing portion of the shaft is compressed onto the face of a servo seat having passages connected to the inside of a drill collar and the rotating action is used to open and/or obstruct a fluid path through those passages. The shaft may include wear-resistant tips to obstruct the fluid path. Part of the torque-transmitting apparatus between the gearmotor and the shaft can be hydrostatically compensated, and part sealed against the operating environment. A magnetic torque coupler may be used as part of the torque-transmitting apparatus between the gearmotor and the shaft. The servo pulser is coupled to a pulser valve, a power source and a sensor package all of which reside inside a short section of drill pipe near the bottom of well bore being drilled.

US Patent Application Publication No. 2019/0368343 A1 to Gopalan entitled "Hydraulically-Assisted Pulser System and Related Methods" teaches an asynchronous top-mounted pulser system for a measurement-while-drilling tool using hydraulic flow, an obstruction, a piston-balance system, and an orifice, to create pressure pulses in drilling fluid, using hydraulic pressure on an obstruction in a main pulser to assist in closing the obstruction. A valve poppet is set above (upstream of) the orifice and is pushed by fluid flow towards a closing position. The piston-balance system, connected to the poppet and located downstream of the orifice in the main pulser, responds to net pressures on the upstream and downstream sides of the piston to move the poppet. The piston also responds to a spring assembly urging the piston downstream, and tending to move the valve poppet to a closed position. A servo pulser, located downstream of the main pulser, opens and closes a rotary shear servo valve-controlled bypass flow path to control the net pressures on the piston.

US Patent Application Publication No. 2020/0199939 A1 to Anderson, et al. teaches a method of creating pressure pulses for pulse telemetry for MWD tools using direct drive. Example embodiments include activating an electric motor of the MWD tool, and thereby turning a motor shaft. Rotating the motor shaft may cause turning of a threaded shaft. Turning the threaded shaft may cause a ball screw nut to translate along the threaded shaft. Translating the ball screw nut may cause translating a piston rod within a cylinder housing. Translating the piston rod may cause movement of the poppet coupled to the piston rod.

Mud pulser devices exist where a servo-valve is located uphole and above, and which controls, a more-downhole main fluid valve.

Thus on a typical standard MWD configuration the so-called mud pulser unit which generates pressure pulses of varying amplitude and duration in order to communicate data to surface when a well is being drilled is positioned in a bottom-most downhole position nearest and thus in closest proximity to the drill bit. One such existing MWD mud pulser device is the mud pulser device described in CA 2,879,026 commonly assigned to the applicant herein.

Disadvantageously, the aforesaid standard MWD mud pulser configuration does not accommodate the use of other downhole smart drilling tools such as LWD (Logging While Drilling) and RSS (Rotary Steerable Systems), which need to be mounted in close proximity to the drill bit and at a location where the MWD mud pulser would otherwise be located.

A need thus exists in the art where the main fluid valve is located uphole of the servo valve and is designed such that it may be effectively and efficiently controlled by the more-downhole servo-valve, which configuration allows for use of other downhole smart drilling tools such as LWD (Logging While Drilling) and RSS (Rotary Steerable Systems).

In particular, and in addition, a need exists in the art for an efficient and effective manner for utilizing a downhole servo-valve to control in an efficient manner, with little force as possible to conserve downhole battery power, a more uphole main fluid valve, for generating pressure pulses to communicate real-time downhole drilling data to surface while drilling a well.

SUMMARY OF THE INVENTION

Advantageously, the present invention provides a "top mount" pulser which enables the main pulse valve to be located in the drill string above (uphole) of the servo valve, thus enabling the use of both LWD and RSS tools positioned on the drill string below (ie. more downhole) of the servo-valve, and in the needed closest proximity to the drill bit.

Servo-valves are typically operated by battery power. Accordingly, it nevertheless remains a requirement that the main valve when generating pressure pulses in the formation in which the well is being drilled be designed so as to be capable of being operated by the servo-valve utilizing as little force as possible, so as to be able to increase the life of the battery which powers the servo-valve and which in turn controls the operation of the main valve generating the pressure pulses.

Thus further advantageously, by using a first channel in a sidewall of the main valve, the present design is further able to in part "balance" uphole pressure forces, and require less robust servo-valves and the fluid pressure which it itself regulates, in order to control the more-uphole main MWD valve.

Accordingly, in order to meet at least the aforesaid objectives, in a broad aspect the present invention provides a mud pulser for generating pressure pulses in a fluid flow in a wellbore.

A valve housing having an uphole opening for receiving the fluid flow is provided.

A moveable piston valve is provided within the valve housing, having a poppet tip thereon for opening and closing the uphole opening.

A piston chamber is provided within which the piston valve longitudinally moves and which extends on a downhole side of said piston valve.

One or more fluid egress ports, in fluid communication with said piston chamber, are further provided.

The poppet tip on the piston valve is receivable in the uphole opening of the valve housing, and forms a main valve. The poppet tip and piston valve are longitudinally moveable between a main-valve open position and a main-valve closed position.

A downhole pilot port is further provided, in fluid communication with the piston chamber, which is adapted to be controlled by the downhole servo valve.

A first channel is provided within the valve housing. The first channel is in fluid communication with a first region of said mud pulser uphole of the uphole opening and longitudinally extends downhole in a sidewall of the valve housing, and (i) fluidly connects, when the downhole pilot port is opened by the downhole pilot valve, the piston chamber with the first region; or (ii) fluidly connects the first region with the piston chamber (504)

Advantageously, the mud pulser of such design is capable of being positioned in a drill string above (ie uphole) of a servo-valve which receives data from one or more smart drilling tools such as LWD (Logging While Drilling) and RSS (Rotary Steerable Systems), which are situated more downhole and in close proximity to the drill bit, to give a more accurate rendition of conditions of the wellbore at the precise location of the drill bit.

The design of the main valve, as hereinafter further explained, in each of its various embodiments, allows for the main valve to be efficiently and effectively controlled by a servo-valve, located more downhole in the wellbore from the main valve.

In a first embodiment, where the first channel fluidly connects the first region with said piston chamber, the downhole pilot port is adapted, when opened by said downhole servo-pilot valve, to allow pressurized fluid from said first channel to flow out of said piston chamber and thereby allow the piston valve and poppet head to move downhole thereby opening or closing said uphole opening and when said downhole pilot port is closed, to allow fluid pressure uphole of said uphole opening and flowing into said piston chamber via said first channel to cause said piston valve and the poppet head thereon to move uphole to thereby respective close or open said uphole opening.

In one sub-embodiment of the first embodiment, the downhole pilot port is adapted, when opened by the downhole servo-pilot valve, to allow pressurized fluid from said first channel to flow out of the piston chamber and thereby cause the piston valve (240) and poppet head (202) to move downhole to a main valve-open position thereby opening the uphole opening, and when the downhole pilot port is closed, allows fluid pressure uphole of the uphole opening and flowing into said piston chamber via the first channel to cause said piston valve and the poppet head thereon to move to a main valve-closed position thereby covering the uphole opening.

In an alternative sub-embodiment to the first embodiment, the downhole pilot port is adapted, when opened by the downhole servo-pilot valve, to allow pressurized fluid from said first channel to flow out of the piston chamber and thereby cause the piston valve and poppet head to move downhole to a main valve-closed position thereby closing the uphole opening, and when the downhole pilot port is closed, allows fluid pressure uphole of the uphole opening and flowing into the piston chamber via the first channel to cause the piston valve and the poppet head thereon to move to a main valve-open position thereby uncovering the uphole opening.

In another alternative embodiment of the broad aspect of the invention, namely in an embodiment where (i) the first channel fluidly connects, when said downhole pilot port is opened by the d downhole pilot valve, the first region with the piston chamber, (ii) the downhole pilot port, when opened by the downhole servo-pilot valve, allows pressurized fluid from the first channel to flow into said piston chamber and move the piston valve and poppet head uphole to a main-valve closed position thereby closing the uphole opening, and when the downhole pilot port is closed, allows fluid pressure uphole of the uphole opening to cause the piston valve (240) and the poppet head (202) thereon to move downhole to the main-valve open position wherein the uphole opening is uncovered.

Alternatively, in an embodiment where again (i) the first channel fluidly connects, when said downhole pilot port is opened by the d downhole pilot valve, the first region with the piston chamber, (ii) the downhole pilot port, when opened by the downhole servo-pilot valve, allows pressurized fluid from the first channel to flow into the piston chamber (504) and move the piston valve and poppet head uphole to a main-valve open position thereby opening the uphole opening, and when the downhole pilot port is closed, allows fluid pressure uphole of the uphole opening to cause the piston valve and the poppet head thereon to move downhole to the main-valve closed position wherein said uphole opening is covered.

In a refinement of such main valve for use in a mud pulser, in an embodiment where the first channel fluidly connects, when the downhole pilot port is opened by the downhole pilot valve (606), the piston chamber with the first region:

- the one or more fluid egress ports comprises a flow line in communication with said piston chamber and said downhole pilot port; and
- the extent, and when, said fluid is allowed to egress the piston chamber is regulated at least in part by said downhole servo-valve opening and closing the downhole pilot port.

In a further refinement of such main valve for use in a mud pulser, the valve housing thereof further comprises a screen member for assisting in preventing unwanted detritus and/or unwanted circulated drilling remnants from passing from the first region into the first channel.

In a preferred embodiment of such refinement the screen member (220) comprises a bore with a plurality of apertures or slots on a periphery thereof for filtering debris in the fluid flow, and the first channel is in fluid communication with said first region uphole of the uphole opening via the plurality of apertures or slots (366) on the screen member through which fluid entering the first channel must pass.

In another alternative or additional refinement of the mud pulser of the present invention the one or more fluid egress ports comprises a single passageway situated in the moveable piston valve, wherein such passageway is in fluid communication with both the piston chamber and directly or indirectly, a second region downhole of the uphole opening. In a preferred embodiment the passageway is further in communication with one or more of the one or more fluid egress ports.

In another important embodiment of the mud pulser of the present invention, for the purposes of advantageously being able to "customize" the mud pulser of the present invention to work most efficiently and effectively in the range of downhole pressures to which the mud pulser may need to operate under, the mud pulser further in one embodiment incorporates a metering orifice. The metering orifice is of a restricted diameter in order to selectively and better regulate the speed by which fluid may egress from the piston chamber, and thus regulate the speed at which the piston valve opens or closes.

Accordingly, in this refinement of the mud pulser of the present invention, wherein at least one of the one or more fluid egress ports contains a metering orifice through which fluid passing through said at least one of said one or more fluid egress ports must pass when said fluid is egressing from said piston chamber.

Advantageously, as the metering orifice can be of selected diameters, a metering orifice can be selected to be of a given diameter which best regulates the speed by which fluid may egress from the piston chamber, and thus best regulate the speed at which the piston valve opens or closes.

For example, when large downhole fluid pressures are encountered, too rapid movement of the piston valve, particularly when such oscillating movement is repeated many hundreds of times, wherein at each extremity of movement the piston valve must be phycially restrained (i.e. come to a "hard" stop at an extremity of travel), may result in physical damage over time to internal components of the mud pulser.

Thus where for example large downhole fluid pressures are encountered, a more restrictive or less restrictive metering orifice, depending on where such metering orifice is positioned, may be selected, so that when fluid pressure is supplied to the piston chamber, one or more of:

- the rate of egress of fluid from the piston chamber, such as by locating such metering orifice in fluid egress passageways or ports; or
- the rate of supply of fluid to the piston chamber, such as by locating such metering orifice in the first channel, or in a passageway fluidly connected to the piston chamber;
- may be regulated, so as to better regulate the speed of the piston valve.

The metering orifice may be incorporated in any of the above embodiments of the invention, to regulate the rate of egress of fluid from the piston chamber or the rate of supply of fluid to the piston chamber.

In a particular embodiment of the mud pulser of the present invention utilizing such a metering orifice, and by way of single non-limiting example, such a mud pulser may comprise:

- a valve housing having an uphole opening for receiving the fluid flow;
- a moveable piston valve within the valve housing, downhole of the uphole opening, having a poppet tip thereon for opening and closing the uphole opening;
- a metering orifice within the moveable piston valve;
- a piston chamber, within which the movable piston valve moves, which is in fluid communication with said metering orifice;
- one or more fluid egress ports in the moveable piston valve, in fluid communication with the metering orifice;
- the poppet tip on the piston valve receivable in the uphole opening of the valve housing and forming a main valve, the poppet tip being moveable between a main-valve open position uncovering the uphole opening and a main-valve closed position covering said uphole opening; and
- a first channel within the valve housing, extending in the sidewall thereof and fluidly connecting, when a downhole pilot port is opened by a downhole pilot valve, an uphole region of the uphole opening with the piston chamber;
- wherein the downhole pilot port, when opened by said downhole pilot valve, allows pressurized fluid from said first channel to flow into the piston chamber and thereby move the piston valve and poppet head to open or close the uphole opening for thereby generating the pressure pulses in the fluid flow.

In the aforementioned non-limiting example, the mud pulser may be configured so that the downhole pilot port, when opened by the downhole pilot valve, allows pressurized fluid from said first channel to flow into the piston chamber and thereby move the piston valve and poppet head to the closed position, while fluid escaping from the piston chamber egresses, by virtue of the metering valve being positioned in or in fluid communication with a fluid egress port, to close the uphole opening in a regulated and controlled manner.

In a further refinement thereof, a passageway may be provided in fluid communication with the piston chamber and the metering orifice, which is further in fluid communication with said one or more fluid egress ports, to thereby regulate the flow of fluid exiting the piston chamber via the passageway and egressing therefrom.

Again, in the particular embodiment of the mud pulser of the present invention utilizing such a metering orifice, a screen member may further be provided for assisting in preventing unwanted detritus and/or unwanted circulated drilling remnants from passing from the said first region into the first channel. In a preferred embodiment the screen member comprises a bore (364) with a plurality of small slots ore apertures on a periphery thereof for filtering debris in the fluid flow; and the first channel is in fluid communication with the first region uphole of the uphole opening via the plurality of apertures or slots on the screen member.

In a still-further aspect of the present invention wherein a metering orifice is utilized to better regulate movement of the piston valve within a mud pulser, the invention comprises an elongate piston valve adapted for longitudinal sliding movement in a mud pulser, for opening and closing an uphole opening in a valve housing within such mud pulser.

In such alternative broad aspect of the invention, a poppet tip is provided at one uphole end of the piston valve. An metering orifice is provided proximate a substantially mutually opposite longitudinal end of the piston valve. At least one fluid egress port is provided, and a passageway of a given diameter is further provided which is in fluid communication with the orifice member and said plurality of drainage ports. The orifice member is a cylindrical member having a bore therein which is equal to or less in diameter than said given diameter of said passageway More particularly, in this alternative broad aspect of the invention, the elongate piston valve comprises:

- a poppet tip at one uphole end thereof;
- an aperture in a base of said elongate piston valve located at a mutually opposite downhole end thereof;
- a passageway of a given diameter in fluid communication with said aperture and longitudinally extending uphole through said elongate piston valve;
- a metering orifice in fluid communication with the passageway and the aperture; and
- wherein the metering orifice is a cylindrical member having an circular bore therein which is equal to or less in diameter than said given diameter of said passageway, and restricts, to a desired degree, fluid flow through passing through said passageway.

Advantageously, by having the orifice member as a discrete component within the movable piston valve, its diameter may be different from that of the passageway to which it is in fluid communication, and thus adjustably selectable.

Thus advantageously in the aforesaid example, a metering orifice having a bore therein of a specific diameter (which diameter may be equal to or less than the diameter of the passageway), may be selected and the bore therein thereby specifically sized to restrict, to a desired extent, the speed at which fluid is allowed to drain via the passageway through the drainage ports, and thus restricting to an extent the speed at which the piston valve will be forced open or closed. Such allows use of a customized moveable piston valve within a mud pulser so as to be best suited for the fluid pressures and fluid viscosities to which the mud pulser will be exposed, and thus allow same to be more effectively controlled by the servo valve when opening and closing the main valve in the mud pulser.

In a further refinement thereof, the piston valve has at least one fluid egress port situated in the passageway, wherein said at least one fluid egress port is in fluid communication with both the passageway and the metering orifice, and the metering orifice further restricts, to a desired degree, fluid flow passing out said fluid egress port, so as to thereby regulate the speed at which the piston valve moves.

BRIEF DESCRIPTION OF THE DRAWINGS

Reference is now made to the drawings, which depict non-limiting embodiments of the invention, in which:

FIGS. 25 to 29B show a process of generating a pressure pulse using the MWD tool shown in FIG. 24A, wherein:

FIG. 25 is a cross-sectional view of a portion of the MWD tool shown in FIG. 23A, showing the pulser assembly shown in FIG. 3A in an initial stage, FIG. 29B illustrates the pressure distribution in the pulser assembly shown in FIG. 3A in the fourth stage.

FIG. 37 is a sectional side perspective view of the embodiment shown in FIG. 28A, when the downhole pilot servo-valve is open, showing the flow of fluid which effectuates closing of the main valve, where egress ports are located in the movable piston valve;

FIG. 38 is a sectional side perspective view of the embodiment shown in FIG. 32, when the downhole pilot servo-valve is open, showing the flow of fluid which effectuates closing of the main valve, where an egress ports is located in the sidewall of the mud pulser, and fluidly connects the piston chamber with a region downhole of the mud pulser;

DETAILED DESCRIPTION OF SOME EMBODIMENTS

Figure 1:
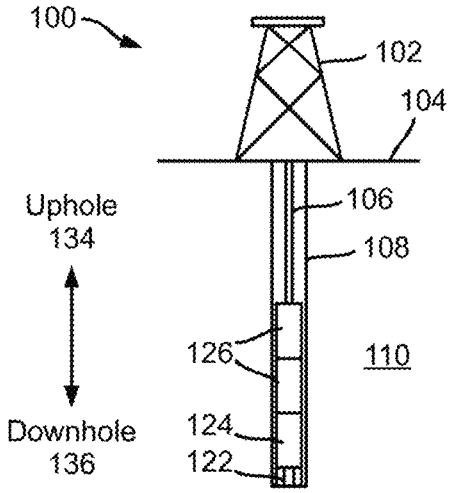
FIG. 1 is schematic diagram showing a drilling system for drilling a wellbore in a subterranean formation, according to some embodiments of this disclosure.

Turning now to FIG. 1, a drilling system according to some embodiments of this disclosure is shown and is generally identified using reference numeral 100. The drilling system 100 in various application scenarios for drilling a borehole or wellbore which in various embodiments may be a vertical wellbore or a horizontal wellbore with a vertical section.

The drilling system 100 generally comprises a drilling rig 102 on the surface 104 with necessary equipment (not shown) known in the art for controlling a drill string 106 to drill a wellbore 108 into a subterranean formation 110.

The drill string 106 generally comprises a plurality of components or subs, including a drill bit 122 at the downhole end of the drilling string 106 for drilling through the formation 110, a measurement-while-drilling (MWD) tool 124 uphole to the drill bit 122 and having a plurality of sensors for collecting and transmitting necessary data, and other subs 126 such as drilling collars uphole thereto as needed. Herein, the term "uphole" refers to a direction or side towards the opening of the wellbore 108 at the surface 104 and is generally identified using reference numeral 134. The term "downhole" refers to a direction or side towards the end of the wellbore 108 and is generally identified using reference numeral 136.

Figure 2:
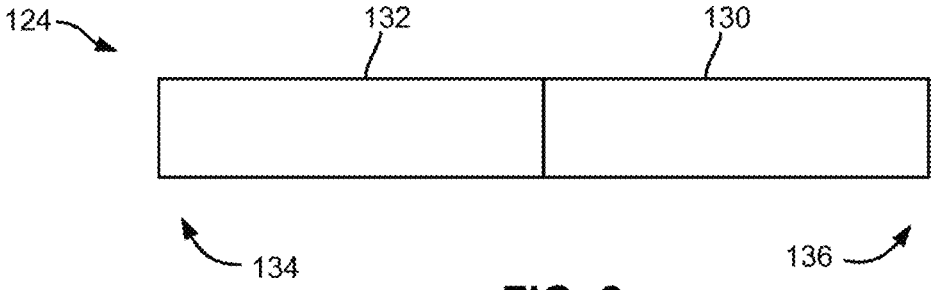
FIG. 2 is a schematic diagram of a measurement-while-drilling (MWD) tool of the drilling system shown in FIG. 1, according to some embodiments of this disclosure.

In these embodiments, the MWD tool 124 is in communication with the equipment on the surface 104 using mud telemetry. As shown in FIG. 2, the MWD tool 124 comprises a measurement structure 130 and a mud-telemetry pulser assembly 132 on "top" or uphole thereto. The measurement structure 130 usually comprises one or more sensors (not shown) for data collection, a circuitry for encoding the collected sensor data, and an electromechanical control structure for driving the pulser assembly 132 to create pressure pulses in the mud or drilling fluid in accordance with the encoded data (i.e., modulating mud pulses) to transmit the encoded data to the surface via the modulated pressure pulses in the drilling fluid. The equipment on the surface 104 may detect the pressure pulses and decode the data for further processing.

Figure 3A:
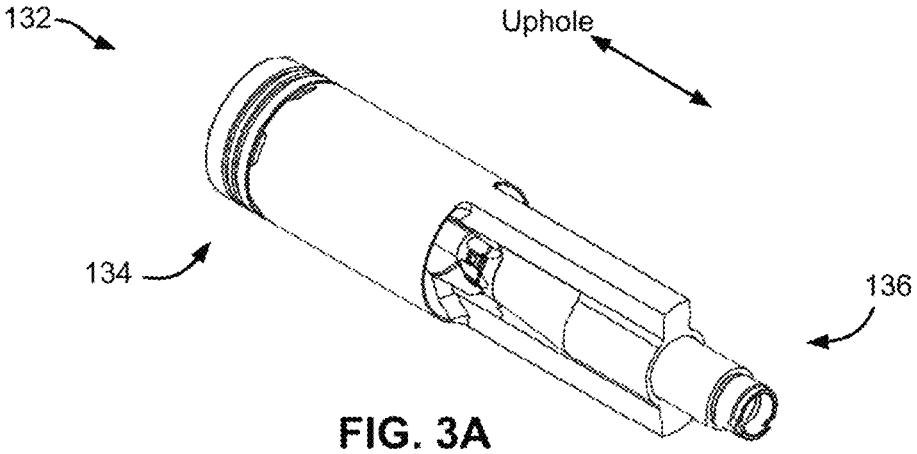
FIG. 3A is a perspective view of a mud-telemetry pulser assembly of the MWD tool shown in FIG. 2, for generating pulses in a drilling mud column for communicating with the surface using the generated pulses, according to some embodiments of this disclosure.
Figure 3B:
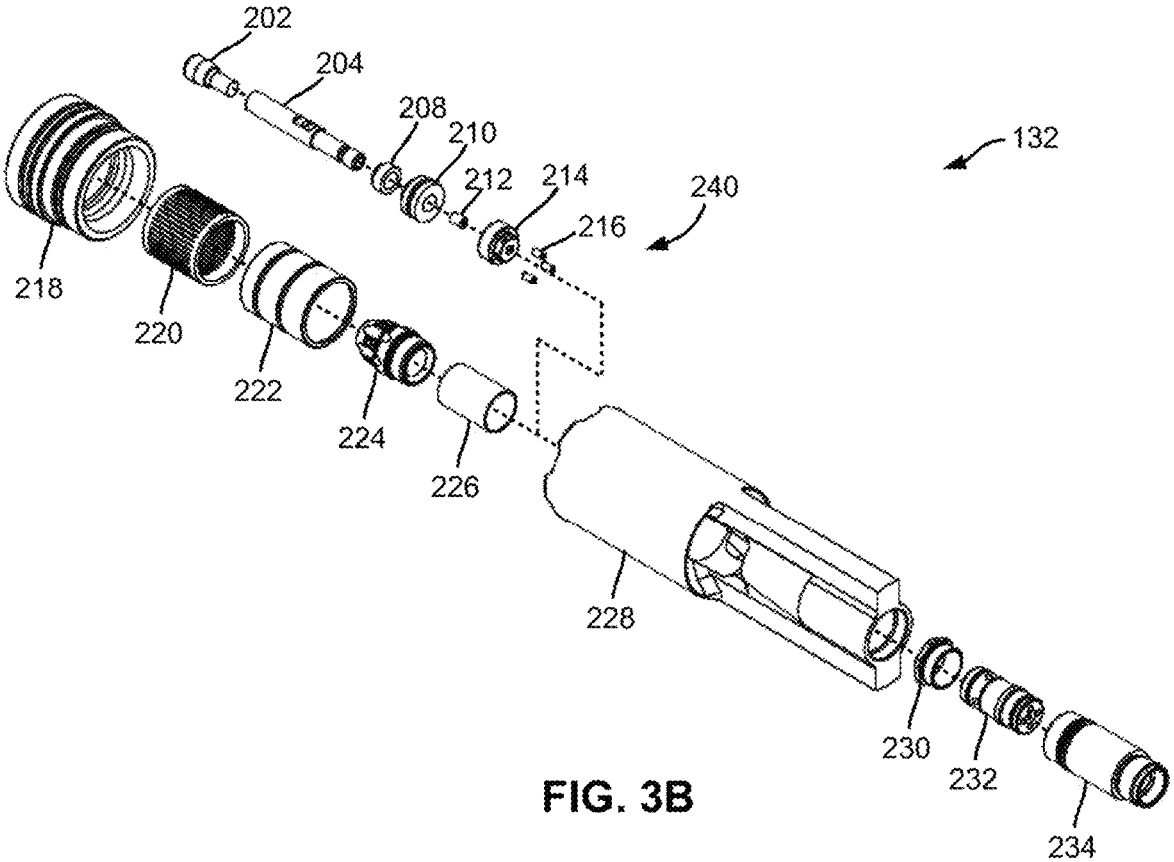
FIG. 3B is an exploded perspective view of the mud-telemetry pulser assembly shown in FIG. 3A.

FIG. 3A is a perspective view of the pulser assembly 132, according to some embodiments of this disclosure. FIG. 3B is an exploded perspective view of the pulser assembly 132 showing the components thereof.

As shown, the pulser assembly 132, naming from inside out and from uphole to downhole, comprises a poppet tip 202, a main shaft 204, a shaft bushing 208, a seal carrier 210, a main shaft orifice 212, a piston cap nut 214, a plurality of screws 216, a seal ring 218, a screen 220, an orifice component 222, a flow cone 224, an abrasive-resistant sleeve 226, a valve body 228, a valve retention collar 230, a pilot manifold 232, and a valve union 234. The components 202 to 216 form a piston 240 for receiving in a piston chamber 504 of the valve body 228, and the components 218 to 234 form a valve housing 502 (described later).

Although not shown, the pulser assembly 132 may also comprise a plurality of seal components such as O-rings at various locations thereof as needed.

Figure 4A:
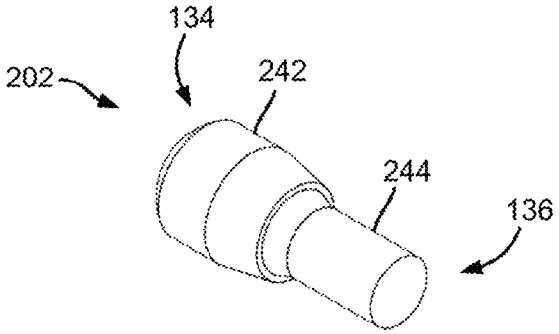
FIG. 4A is a perspective view of a poppet tip of the mud-telemetry pulser assembly shown in FIG. 3A.
Figure 4B:
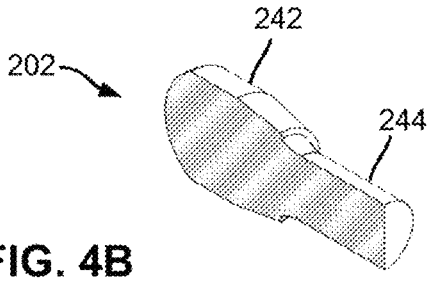
FIG. 4B is a perspective cross-sectional view of the poppet tip shown in FIG. 4A.

As shown in FIGS. 4A and 4B, the poppet tip 202 has a solid core and comprises a radially expanded head portion 242 on the uphole side 134 thereof and a male coupling portion 244 on the downhole side 136 thereof for coupling to the main shaft 204 using suitable coupling methods such as press fit, glue, solder, threading, brazing, and/or the like. In some embodiments, the poppet tip 202 may be made of a suitable rigid material such as tungsten carbide or ceramic for achieving a long life span in its exposure to the high-velocity and erosive drilling mud.

Figure 5A:
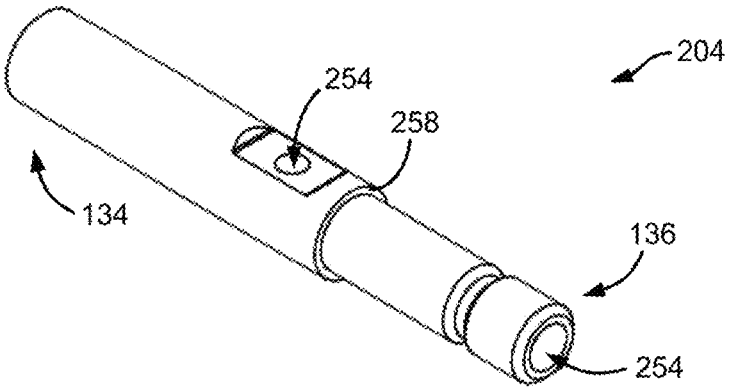
FIG. 5A is a perspective view of a main shaft of the mud-telemetry pulser assembly shown in FIG. 3A.
Figure 5B:
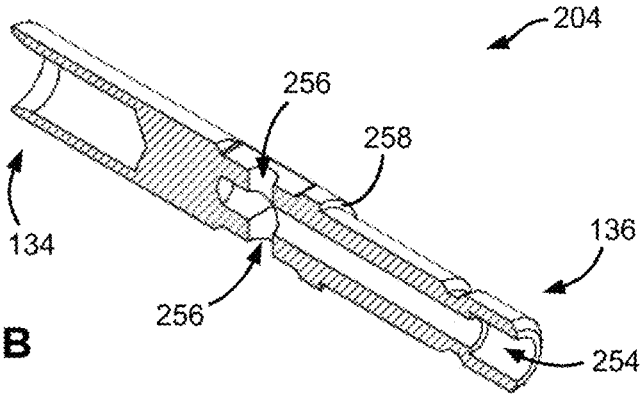
FIG. 5B is a perspective cross-sectional view of the main shaft shown in FIG. 5A.
Figure 5C:
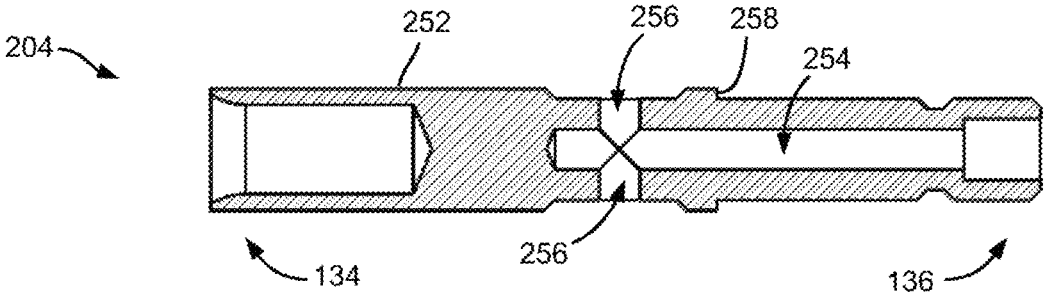
FIG. 5C is a cross-sectional view of the main shaft shown in FIG. 5A.

As shown in FIGS. 5A to 5C, the main shaft 204 is an elongated structure with a female uphole end 134 for coupling to the coupling portion 244 of the poppet tip 202 using a suitable coupling method as described above, and a threaded male downhole end 136 for coupling to the piston cap nut 214. The main shaft 204 also comprises a bore 254 longitudinally extending from the downhole end 136 to one or more ports 256 on the sidewall thereof at positions intermediate the uphole and downhole ends 134 and 136. On the exterior side thereof, the main shaft 204 comprises a downhole facing, circumferential shoulder 258.

Figure 6A:
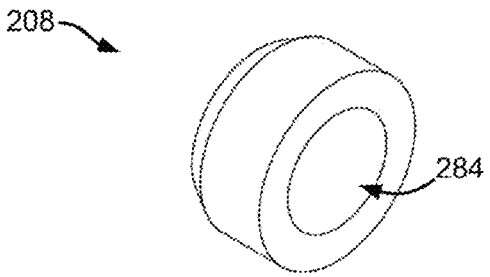
FIG. 6A is a perspective view of a shaft bushing of the mud-telemetry pulser assembly shown in FIG. 3A.
Figure 6B:
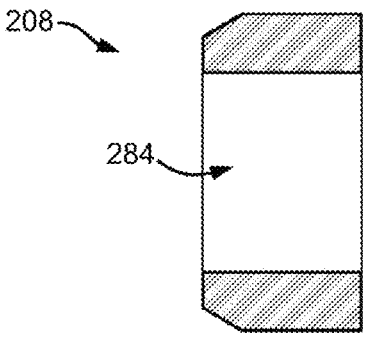
FIG. 6B is a cross-sectional view of the shaft bushing shown in FIG. 6A.

As shown in FIGS. 6A and 6B, the shaft bushing 208 is a substantially cylindrical structure with a bore 284 longitudinally extending therethrough.

Figure 7A:
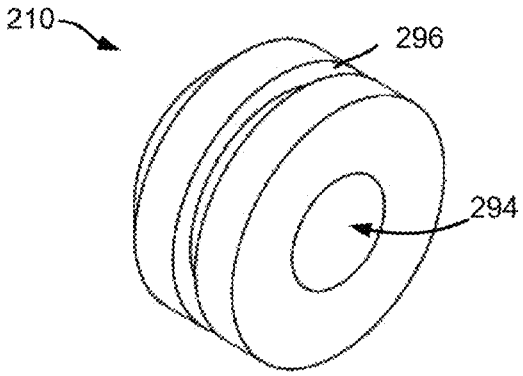
FIG. 7A is a perspective view of a seal carrier of the mud-telemetry pulser assembly shown in FIG. 3A.
Figure 7B:
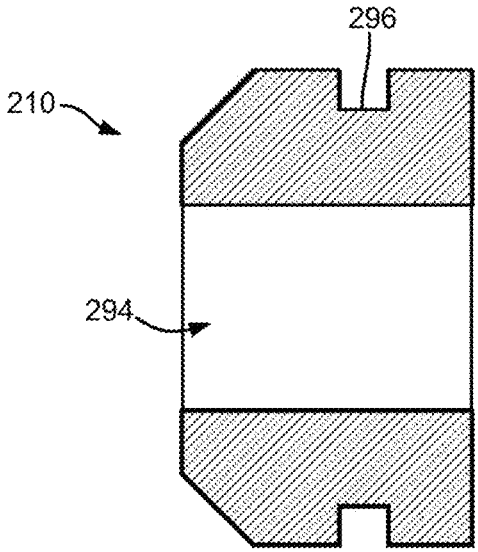
FIG. 7B is a cross-sectional view of the seal carrier shown in FIG. 7A.

As shown in FIGS. 7A and 7B, the seal carrier 210 is a substantially cylindrical structure with a bore 294 longitudinally extending therethrough. The seal carrier 210 also comprises a circumferential groove 296 on the exterior side thereof for receiving therein a seal component such as an O-ring.

Figure 8A:
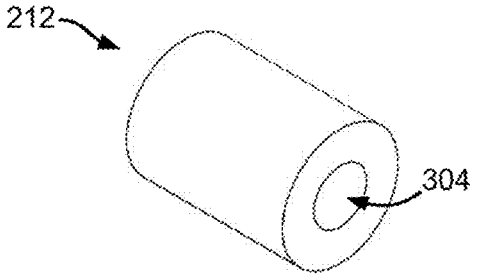
FIG. 8A is a perspective view of a main shaft orifice of the mud-telemetry pulser assembly shown in FIG. 3A.
Figure 8B:
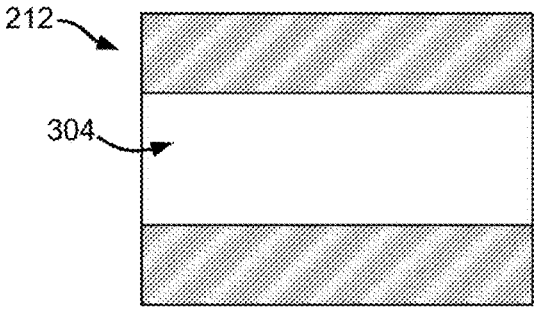
FIG. 8B is a cross-sectional view of the main shaft orifice shown in FIG. 8A.

As shown in FIGS. 8A and 8B, the main shaft orifice 212 is a cylindrical structure with a bore 304 longitudinally extending therethrough. The bore 304 has a suitable inner diameter (ID) for metering the discharge from the piston's pressure volume.

Figure 9A:
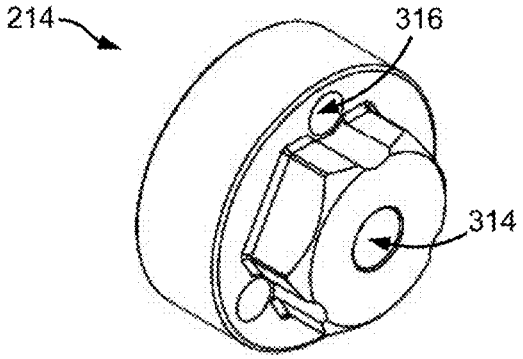
FIG. 9A is a perspective view of a piston cap nut of the mud-telemetry pulser assembly shown in FIG. 3A.
Figure 9B:
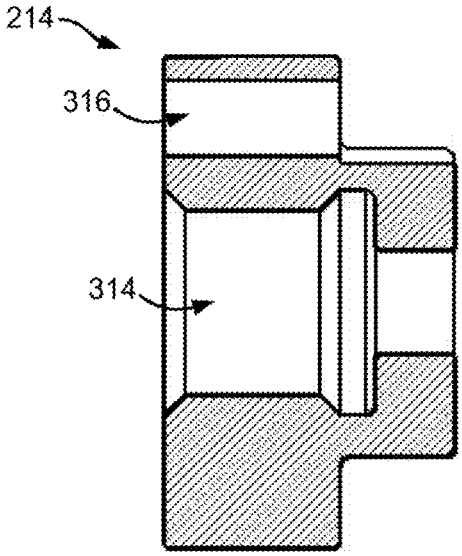
FIG. 9B is a cross-sectional view of the piston cap nut shown in FIG. 9A.

As shown in FIGS. 9A and 9B, the piston cap nut 214 is a cylindrical structure with a bore 314 longitudinally extending therethrough and with a threaded inner surface for coupling to the main shaft 204. The piston cap nut 214 also comprises a plurality of screw holes 316 for receiving a plurality of set screws 216 which resist loosening of the piston cap nut 214 by tensioning the threaded joint between the main shaft 204 and the piston cap nut 214 in a manner similar to that of a "multi-jackbolt tensioner", while simultaneously clamping the shaft bushing 208 and the seal carrier 210 in place.

Figure 10A:
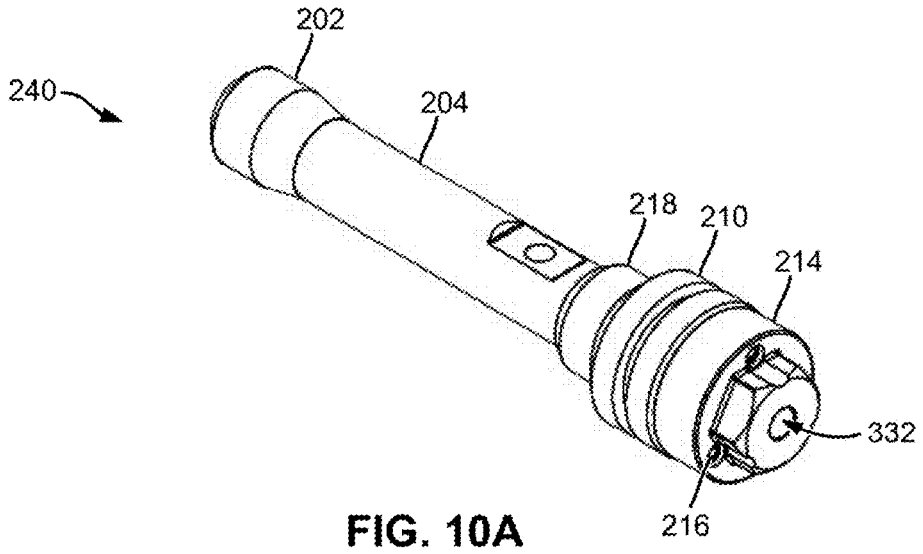
FIG. 10A is a perspective view of a piston of the mud-telemetry pulser assembly shown in FIG. 3A, formed by the components shown in FIGS. 4A to 9B.
Figure 10B:
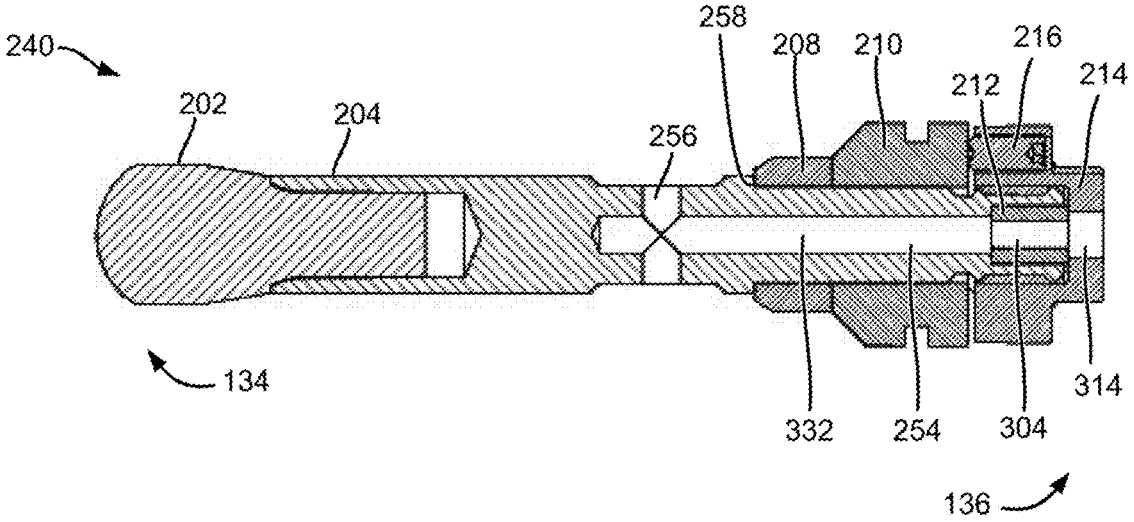
FIG. 10B is a cross-sectional view of the piston shown in FIG. 10A.

After assembly, the components 202 to 216 form a piston 240. As shown in FIGS. 10A and 10B, the poppet tip 202 is coupled to the uphole end of the main shaft 204, and the main shaft 204 extends through the shaft bushing 208 and the seal carrier 210, and coupled to the piston cap nut 214. The shoulder 258 of the main shaft 204 engages the uphole end of the shaft bushing 208 and thus retaining the shaft bushing 208 and the seal carrier 210 between the main shaft 204 and the piston cap nut 214.

As shown in FIG. 10B, after assembly, the piston 240 comprises a channel 332 extending from the downhole end 136 thereof to the ports 256 of the main shaft 204.

Figure 11A:
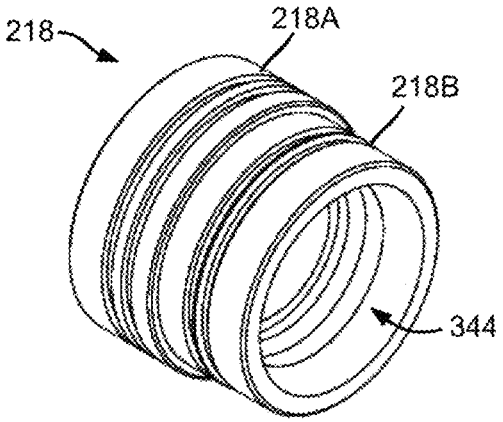
FIG. 11A is a perspective view of a seal ring of the mud-telemetry pulser assembly shown in FIG. 3A.
Figure 11B:
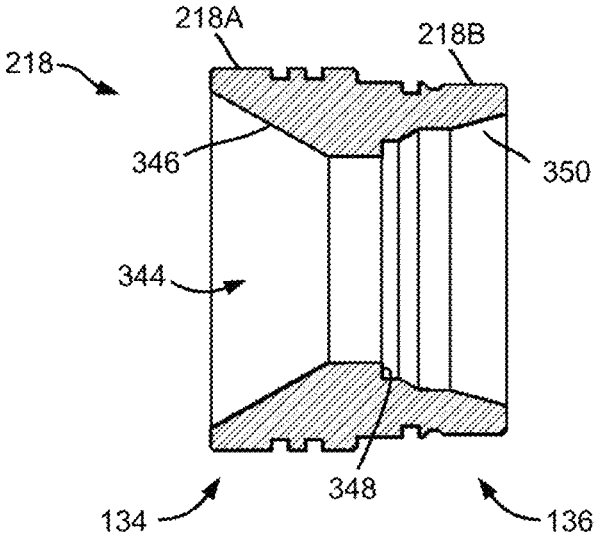
FIG. 11B is a cross-sectional view of the seal ring shown in FIG. 11A.

As shown in FIGS. 11A and 11B, the seal ring 218 is a substantially cylindrical structure with a bore 344 longitudinally extending therethrough. The seal ring 218 has an uphole coupling portion 218A for coupling to a suitable sub, and comprises a downhole facing circumferential shoulder 348 extending radially inwardly from a position intermediate the uphole and downhole portions 218A and 218B. At least a portion 350 of the downhole portion 218B of the seal ring 218 has an ID greater than the OD of the screen 220, thereby forming a chamber for drilling fluid to pass through the screen 220 into a side channel of the valve body 228 (described in more detail later).

Figure 12:
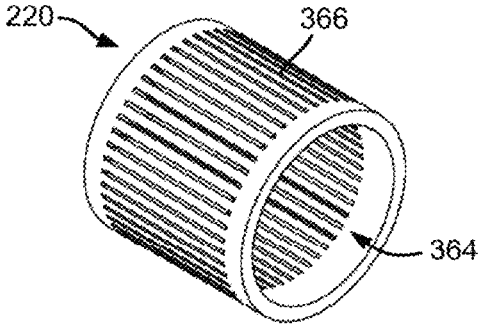
FIG. 12 is a perspective view of a screen of the mud-telemetry pulser assembly shown in FIG. 3A.

FIG. 12 is a perspective view of the screen 220, which is substantially a cylindrical structure having a bore 364 longitudinally extending therethrough. The screen 220 comprises a plurality of longitudinal apertures, in one embodiment in the form of slots 366 circumferentially uniformly distributed on the sidewall thereof for filtering debris that may otherwise enter the side channel 442 of the valve body 228 (described later).

Figure 13A:
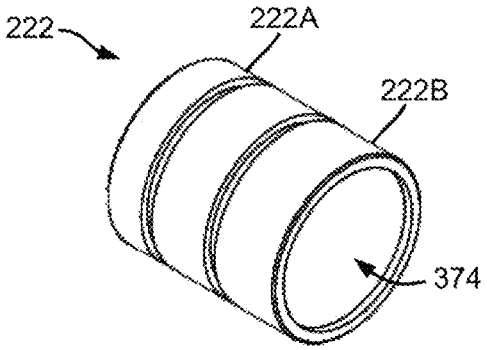
FIG. 13A is a perspective view of an orifice of the mud-telemetry pulser assembly shown in FIG. 3A.
Figure 13B:
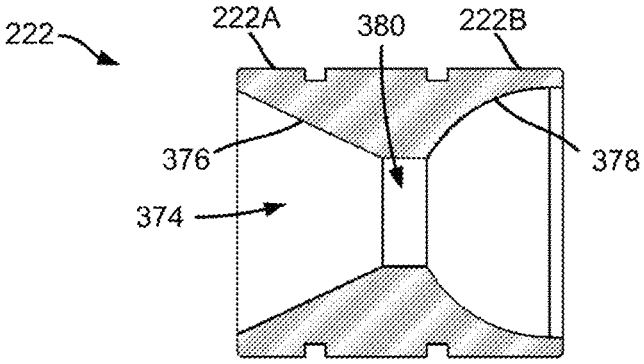
FIG. 13B is a cross-sectional view of the orifice shown in FIG. 13A.

As shown in FIGS. 13A and 13B, the orifice component 222 is a substantially cylindrical structure with a bore 374 longitudinally extending therethrough. The orifice component 222 comprises an uphole portion 222A with an inner surface 376 tapering inwardly and downhole, and a downhole portion 222B with a semi-spherical inner surface 378, thereby forming an orifice 380 with reduced ID at the interface of the uphole and downhole portions 222A and 222B.

Figure 14A:
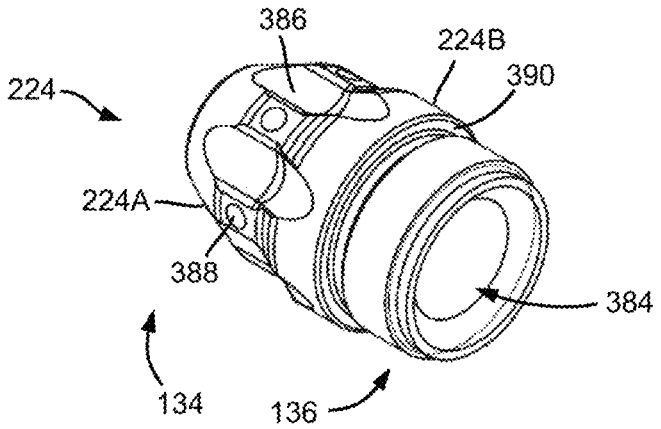
FIGS. 14A and 14B are perspective views of a flow cone of the mud-telemetry pulser assembly shown in FIG. 3A.
Figure 14B:
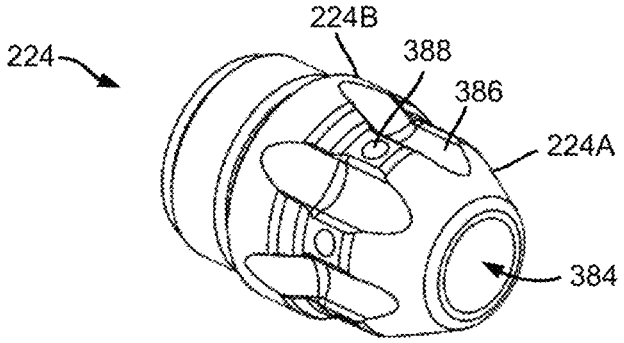
Figure 14C:
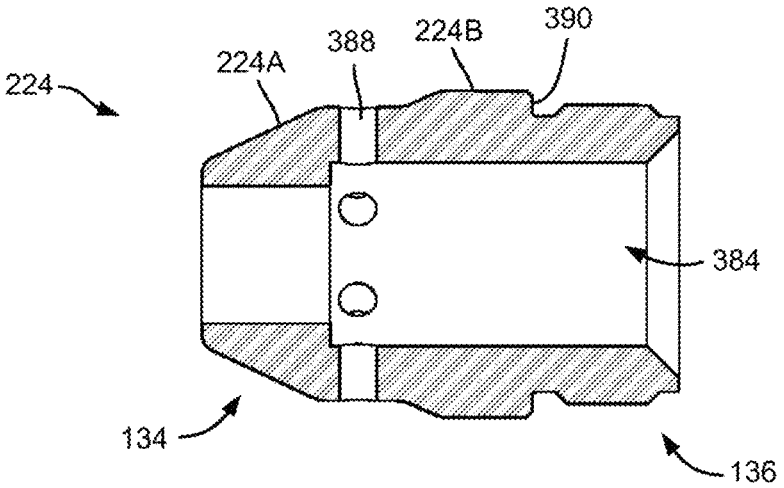
FIG. 14C is a cross-sectional view of the flow cone shown in FIG. 14A.

As shown in FIGS. 14A to 14C, the flow cone 224 comprises a cylindrical downhole portion 224B, a tapering uphole portion 224A, and a bore 384 longitudinally extending therethrough. The flow cone 224 comprises a plurality of cutouts 386 on the exterior surface thereof about the interface of the uphole and downhole portions 224A and 224B, and circumferentially uniformly distributed thereon, for engaging with a socket (not shown) inserted from the uphole end 134 of the valve body 228 for tightening the flow cone 224 in place. The flow cone 224 also comprises one or more ports 388 each intermediate a pair of cutouts 386 and extending from the exterior surface radially inwardly into the bore 384 and in fluid communication therewith. As more fully explained herein, ports 388 serve as draining ports to allow fluid trapped in the pilot chamber 504 to flow out. The downhole portion 224B of the flow cone 224 also comprises a downhole facing, circumferential shoulder 390 on the exterior surface thereof.

The abrasive-resistant sleeve 226 is a cylindrical structure made of a suitable rigid material such as ceramic for providing a hard, long-lasting seal running surface against the abrasive mud fluid (due to sand and other solids suspended therein) for the seal mounted on the seal carrier 210 movable thereon during operation.

The valve body 228 is shown in FIGS. 15A to 15E. As shown, the valve body 228 is an elongated structure with a bore 404 longitudinally extending therethrough. The valve body 228 comprises an uphole portion 228A and a downhole portion 228B with one or more (e.g., two) ports 406 on the sidewall thereof at the interface of the uphole and downhole portions 228A and 228B. The downhole portion 228B has reduced outer diameter (OD) along two laterally opposite sides such that the ports 406 substantially face downhole.

In the bore 404, the uphole portion 228A comprises a coupling section 408 adjacent the uphole end 134 thereof for receiving the downhole portion 218B of the seal ring 218B, and a screen chamber 410 for receiving the screen 220, wherein a portion of the screen chamber has an ID greater than the OD of the screen 220, forming a portion of the fluid chamber 350 (also see FIG. 11B). Downhole to the screen chamber 410, the uphole portion 228A of the valve body 228 comprises an uphole facing, radially inwardly extending, circumferential seat 412 for engaging the orifice component 222.

In the bore 404, the downhole portion 402B comprises an uphole facing, radially inwardly extending, circumferential seat 414 downhole to the ports 406, for engaging the shoulder 380 of the flow cone 224. The downhole portion 402B also comprises a radially inwardly extending, circumferential ridge 416 at a distance downhole to the seat 414, thereby forming an uphole facing shoulder 418 on the uphole side thereof, and a downhole facing seat 420 on the downhole side thereof for engaging the pilot manifold. The downhole facing seat 420 and the downhole end 136 of the valve body 228 form a pilot chamber 424 for receiving the valve retention collar 230, the pilot manifold 232, and a coupling portion of the valve union 234. The pilot chamber 424 comprises a circumferential groove 426.

Figure 15A:
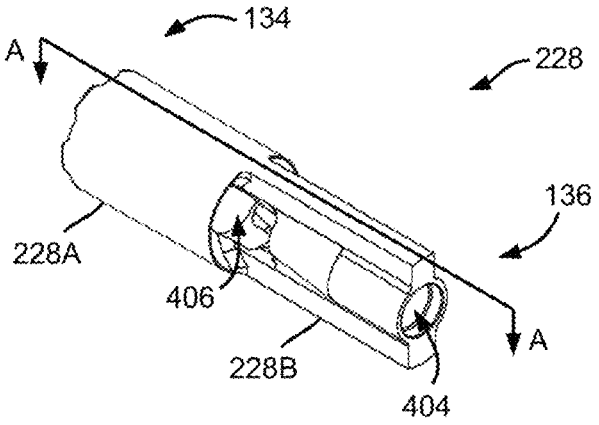
FIGS. 15A and 15B are perspective views of a valve body of the mud-telemetry pulser assembly shown in FIG. 3A.
Figure 15B:
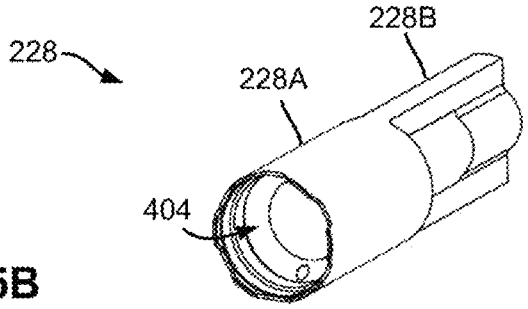
Figure 15C:
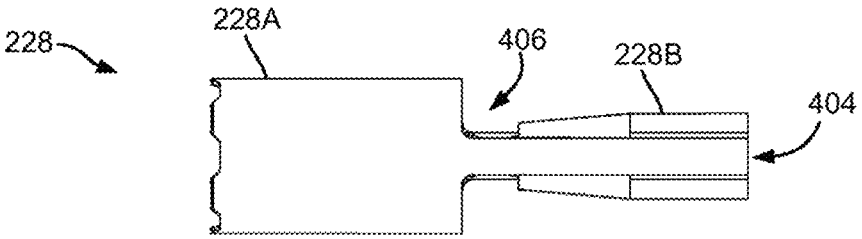
FIG. 15C is a top plan view of the valve body shown in FIG. 15A.
Figure 15D:
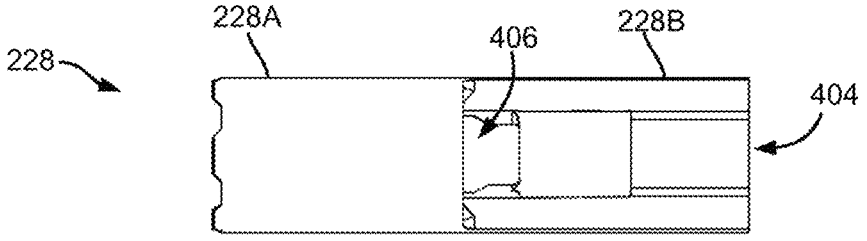
FIG. 15D is a partial side elevation view of the valve body shown in FIG. 15A.
Figure 15E:
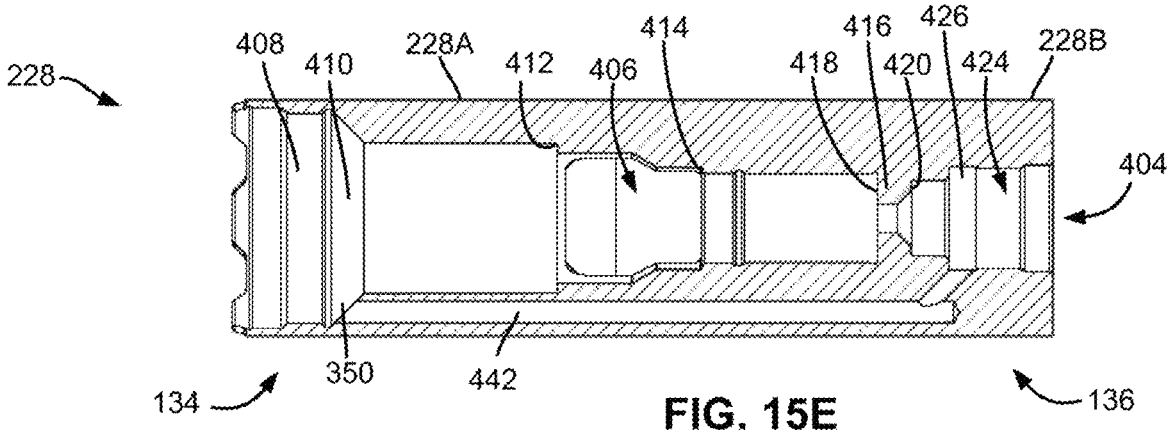
FIG. 15E is a cross-sectional view of the valve body shown in FIG. 15A.

As shown in FIG. 15E, the valve body 228 also comprises a side channel 442 radially spaced from the bore 404 and extending longitudinally in the sidewall of the valve body 228 from the screen chamber 410 to the downhole portion 228A and fluidly connecting to the circumferential groove 426 of the pilot chamber 424.

Figure 16A:
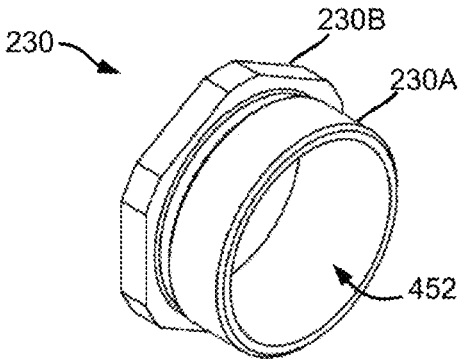
FIG. 16A is a perspective view of a valve retention collar shown in FIG. 3A.
Figure 16B:
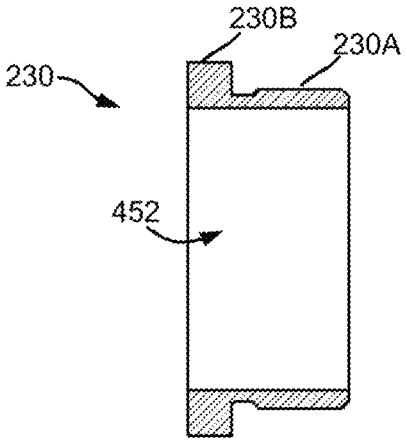
FIG. 16B is a cross-sectional view of the valve retention collar shown in FIG. 16A.

FIGS. 16A and 16B show the valve retention collar 230, which comprises a cylindrical body 230A with a bore 452 longitudinally extending therethrough and an outwardly extend circumferential rim 230B.

Figure 17A:
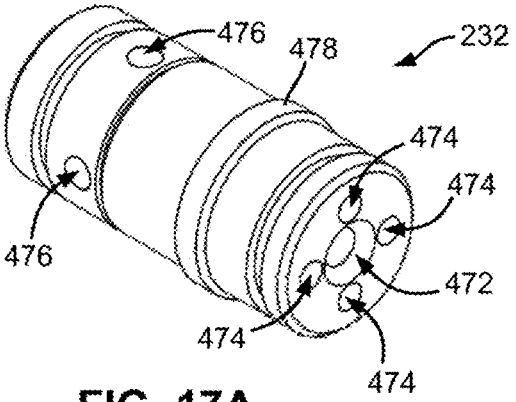
FIG. 17A is a perspective view of a pilot manifold shown in FIG. 3A.
Figure 17B:
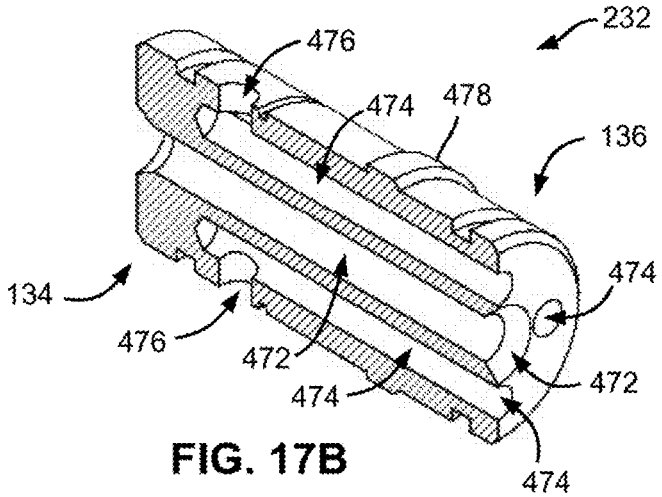
FIG. 17B is a cross-sectional view of the pilot manifold shown in FIG. 17A.

FIGS. 17A and 17B show the pilot manifold 232. As shown, the pilot manifold 232 is a cylindrical structure having a circumferential ridge 478 radially outwardly extending from the exterior surface thereof. The pilot manifold 232 comprises a bore 472 longitudinally extending therethrough and a plurality of side channels 474 extending longitudinally from the downhole end 136 uphole and fluidly connecting to a plurality of ports 476 on the sidewall about the uphole end 134 thereof. The downhole opening 472' of the bore 472 forms a port for engaging with a pilot valve (described in more detail later). In some embodiments, the port 472' has a conical profile with an inner surface tapering radially inwardly and longitudinally uphole for providing a fluid seal when engaging with the pilot valve.

Figure 18A:
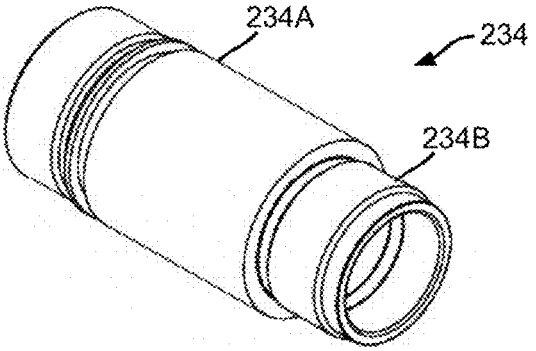
FIG. 18A is a perspective view of a valve union shown in FIG. 3A.
Figure 18B:
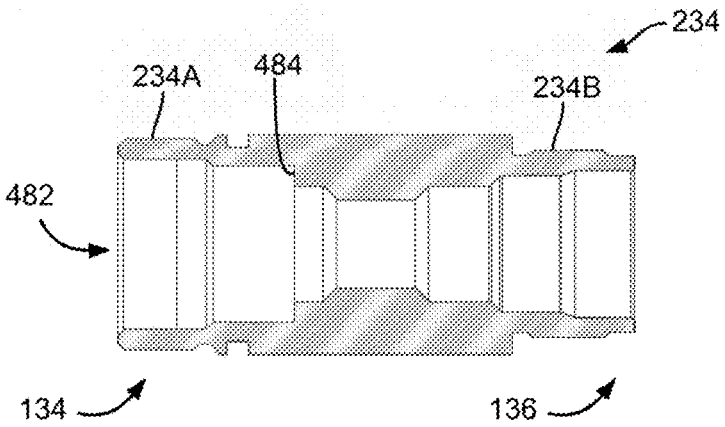
FIG. 18B is a cross-sectional view of the valve union shown in FIG. 18A.

FIGS. 18A and 18B show the valve union 234. As shown, the valve union 234 is a cylindrical structure having a bore 482 longitudinally extending therethrough. The valve union 234 comprises an uphole portion 234A for coupling to the valve retention collar 230 and a downhole coupling portion 234B for coupling to another sub such as a pilot valve sub (not shown). The valve union 234 also comprises a radially inwardly extending, uphole facing, circumferential should 484 intermediate the uphole and downhole ends 134 and 136.

Figure 19:
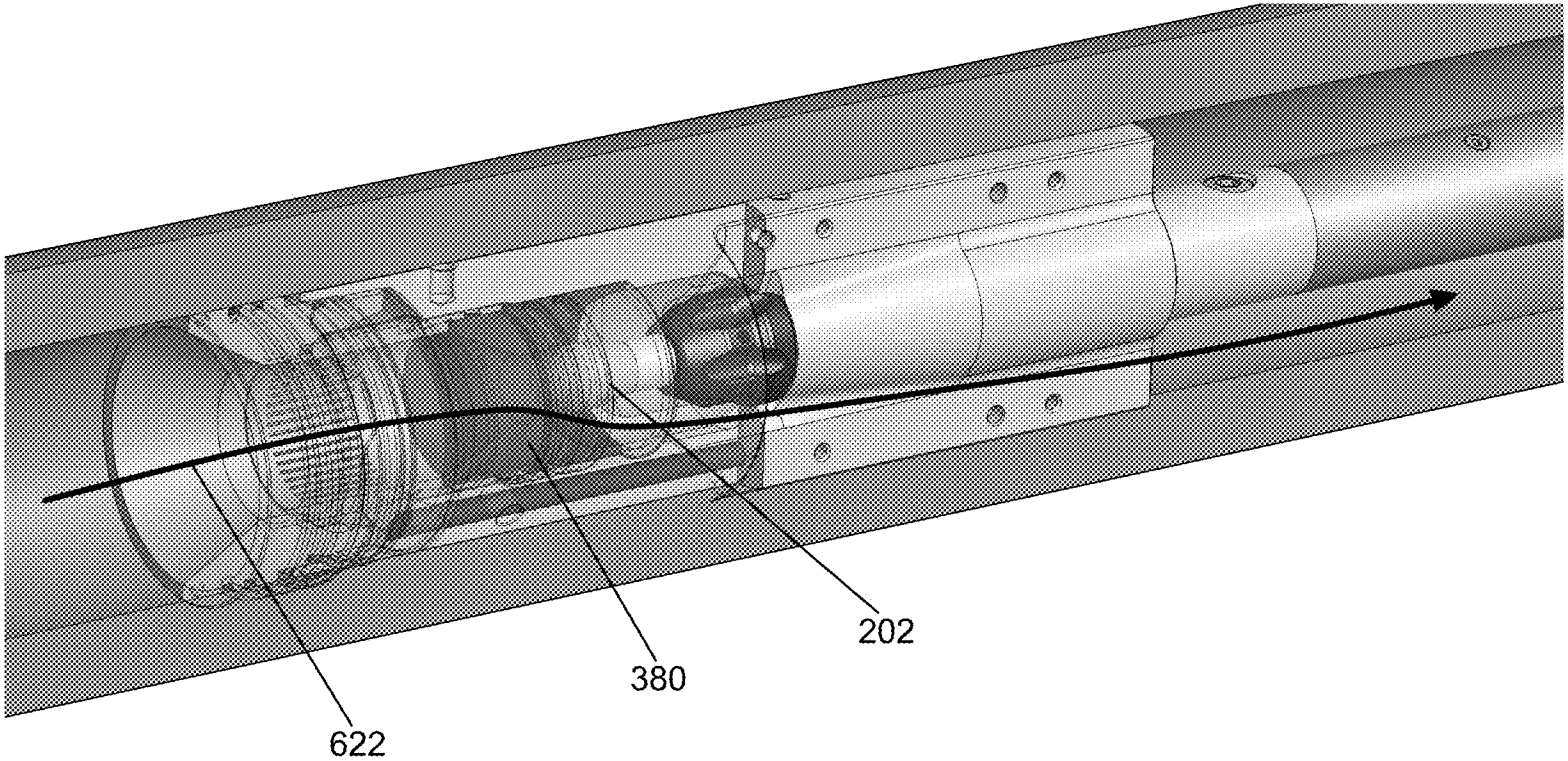
FIG. 19 is a side perspective partly transparent view, looking from uphole on the left-hand side to downhole on the righthand side, of an embodiment of the mud pulser of the present invention, showing the flow of fluid downhole when the uphole opening is open.

FIG. 19 is a side perspective partly transparent view, looking from uphole on the left-hand side to downhole on the righthand side, of an embodiment of the mud pulser 132 of the present invention, showing the mud fluid flow 622 downhole when the uphole opening 380 is open by the poppet tip 202 of the movable piston 240.

Figure 20:
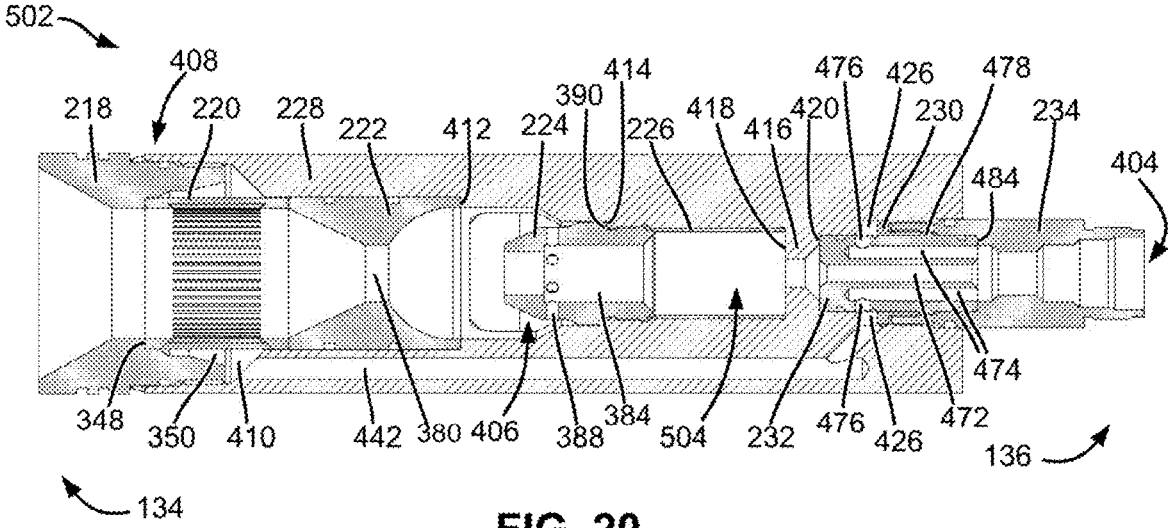
FIG. 20 is a cross-sectional view of a valve housing of the mud-telemetry pulser assembly shown in FIG. 3A, formed by the components shown in FIGS. 11A to 18B.
Figure 21:
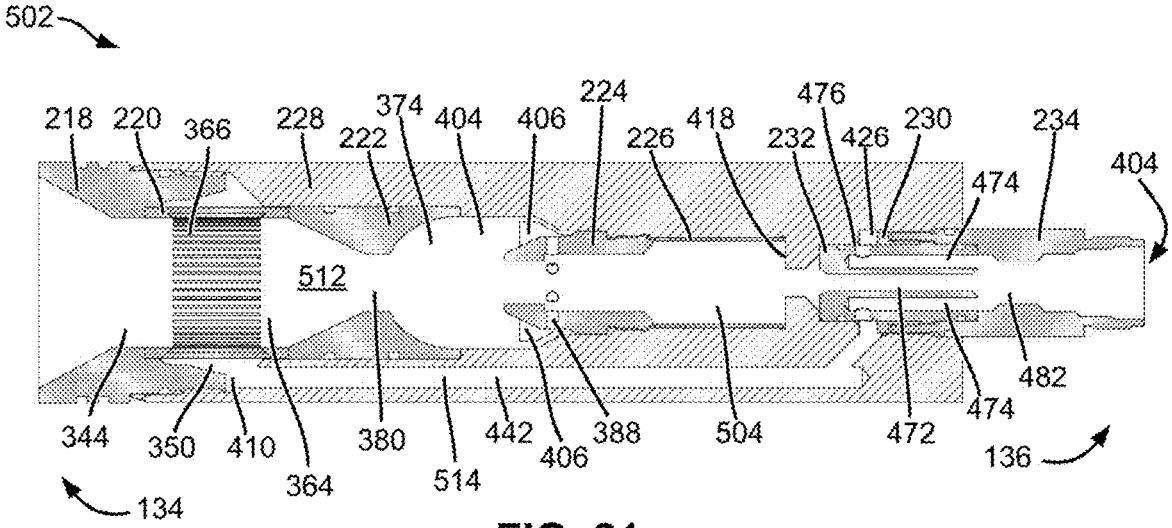
FIG. 21 is the cross-sectional view of a valve housing shown in FIG. 20, illustrating a first region 512 for fluid flow in the main body of the valve housing and and a first channel 514 in the sidewall of the valve housing.

After assembly, the components 218 to 234 form a valve housing 502. As shown in FIG. 20, uphole to the ridge 416, the valve body 228 receives in the bore 404 a downhole portion of the seal ring 218, the screen 220, the orifice component 222, the flow cone 224, and the abrasive-resistant sleeve 226. The seal ring 218 is coupled to the coupling section 408 of the valve housing 502, the orifice component 222 is received in the bore 404 against the shoulder 412 thereof, and the screen 220 is retained between the seal ring 218 and the orifice component 222 against the shoulder 348 of the seal ring 218 on the uphole side and against the orifice component 222 on the downhole side thereof. The flow cone 224 is received in the bore 404 with the shoulder 390 against the seat 414 thereof, and retains the abrasive-resistant sleeve 226 in the bore 404 of against the shoulder 418 of the valve body 228.

Downhole to the ridge 416, the valve body 228 receives in the bore 404 the valve retention collar 230, the pilot manifold 232, and the valve union 234. The valve retention collar 230 is coupled to the valve union 234 downhole thereto. The pilot manifold 232 extends through the valve retention collar 230 into the valve union 234 against the shoulder 484 thereof and is retained in place by the valve retention collar 230 engaging the ridge 478 of the pilot manifold 232.

After assembly, the bore 384 of the flow cone 224 and the shoulder 418 of the valve body 228 define a piston chamber 504. Moreover, the ports 476 of the pilot manifold 232 overlap the circumferential groove 426 of the valve body 228.

The valve housing 502 comprises a main channel 512 and a secondary channel 514. As shown in FIG. 20A, the main channel 512 is uphole to the flow cone 224 extending from the uphole end 134 downhole and fluidly connected to the ports 406 of the valve body 228. The piston 240 acts as a main valve for opening and closing the main channel 512.

The secondary channel 514 is fluidly connected to the main channel 512 through the apertures/slots 366 of the screen 220 and the fluid chamber 350 of the valve body 228, and extends along the side channel 442 of the valve body 228 into the circumferential groove 426 of the valve body 228, which is then fluidly connected through the side channels 474 of the pilot manifold 232, the bore 482 of the valve union 234, and the bore 472 of the pilot manifold 232, to the piston chamber 504.

Figure 22A:
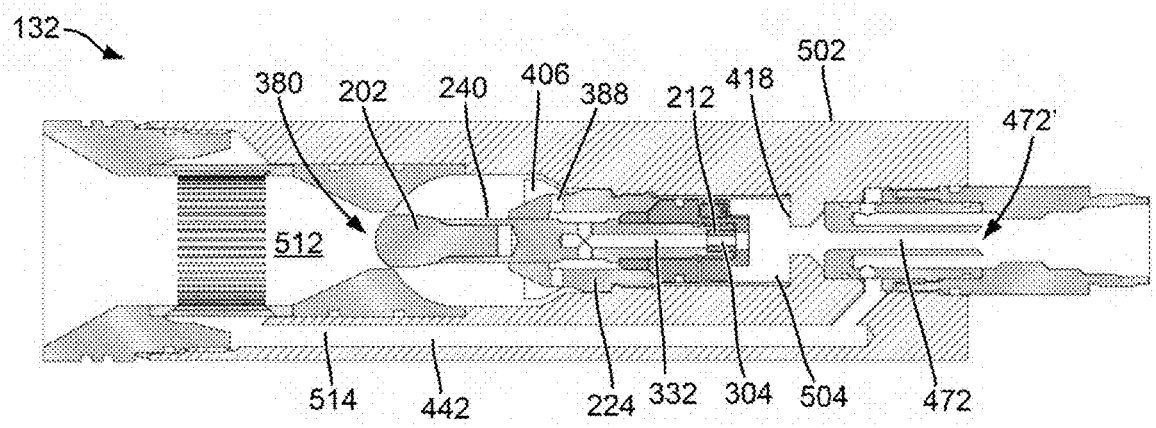
FIG. 22A is a cross-sectional view of the mud-telemetry pulser assembly shown in FIG. 3A, wherein a main valve of the mud-telemetry pulser assembly is in a closed state.
Figure 22B:
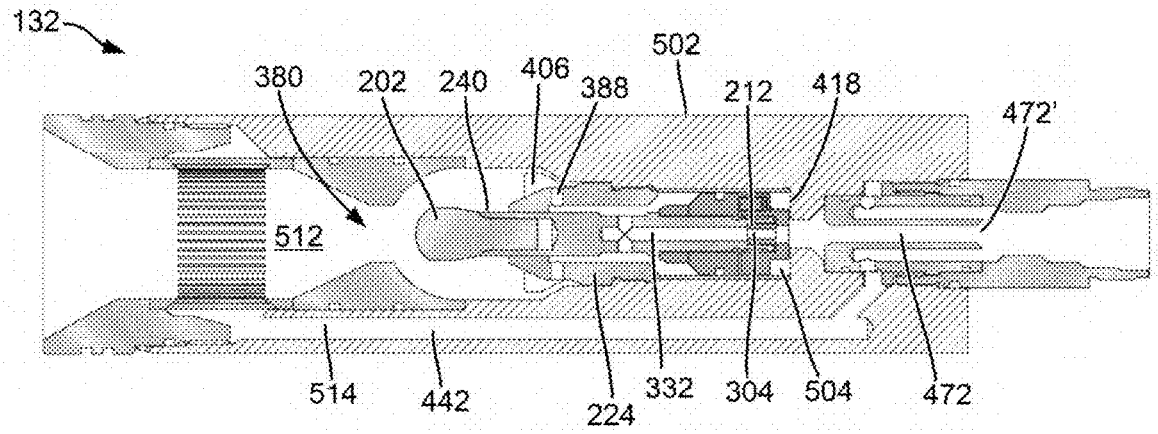
FIG. 22B is a cross-sectional view of the mud-telemetry pulser assembly shown in FIG. 3A, wherein the main valve of the mud-telemetry pulser assembly is in an open state.

FIG. 22A is a cross-sectional view of the pulser assembly 132 in a main-valve closed state. FIG. 22B is a cross-sectional view of the pulser assembly 132 in a main-valve open state. As shown, the piston 240 is longitudinally movably received in the piston chamber 504 of the piston housing 502. The poppet tip 202 of the piston 240 has an OD slightly smaller than the ID of the orifice 380 of the valve housing 502. Thus, the pulser assembly 132 is in the main-valve closed state and the main channel 512 is closed (i.e., fluidly isolated from the ports 406 of the valve housing 502) when the piston 240 moves uphole and the poppet tip 202 thereof extends into and at least partially blocks the orifice 380.

The pulser assembly 132 is in the main-valve open state and the main channel 512 is open (i.e., in fluidly communication with the ports 406 of the valve housing 502), when the piston 240 moves downhole and the poppet tip 202 thereof is away from the orifice 380.

The secondary channel 514 is in fluid communication with the ports 388 of the flow cone 224 at the uphole end thereof, and extends through the side channel 442 of the valve housing 502 into the piston chamber 504 via the pilot port 472' (the downhole opening of the bore 472 of the pilot manifold 232), from which the secondary channel 514 is fluidly connected to the channel 332 of the piston 240 and in turn to the ports 406 of the valve housing 502 via the ports 388 of the flow cone 224. Therefore, the secondary channel 514 is in fluid communication with the ports 406 of the valve housing 502 in both the main-valve closed state and the main-valve open state. However, as will be described in more detail later, the pilot port 472' may be open or closed by a pilot valve to open or close the secondary channel 514.

Figure 23:
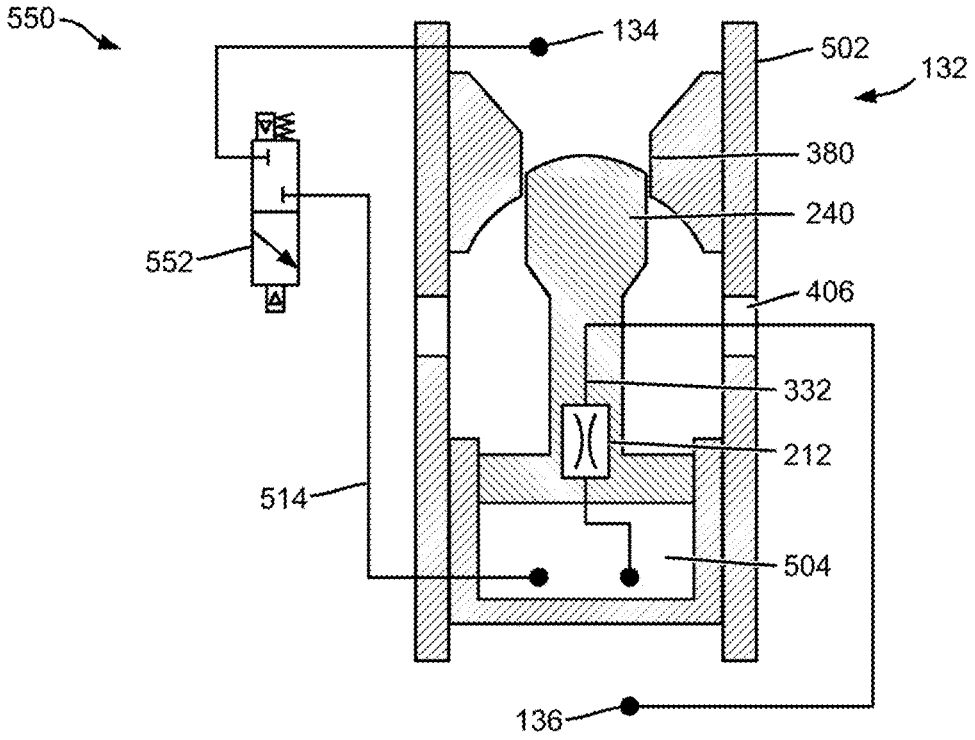
FIG. 23 is a schematic diagram of a system such as a MWD tool having the mud-telemetry pulser assembly shown in FIG. 3A for generating modulated pressure pulses, according to some embodiments of this disclosure.

FIG. 23 is a flow schematic diagram showing a system 550 such as a MWD tool using the above-described mud-telemetry pulser assembly 132 for generating modulated pressure pulses. As shown, an electromechanical structure 552 such as a solenoid or a linear actuator is coupled to the secondary channel 514 for controlling the fluid flow from the uphole side 134 via the secondary channel 514 to the piston chamber 504 to actuate the piston 240 to the main-valve open state and the main-valve closed state.

The channel 332 of the piston 240 provides a bleeding channel for discharging the fluid flow from the piston chamber 504 through the port 406 and travelling downhole through the drill string 106, passing through a mud motor and/or a rotary-steerable system, flowing through nozzles in the drill bit 122, and then returning uphole through the annulus between the drill string 106 and the wellbore 108. The main shaft orifice 212 of the piston 240 acts as a flow restrictor for metering the discharge from the piston's pressure volume.

Figure 24A:
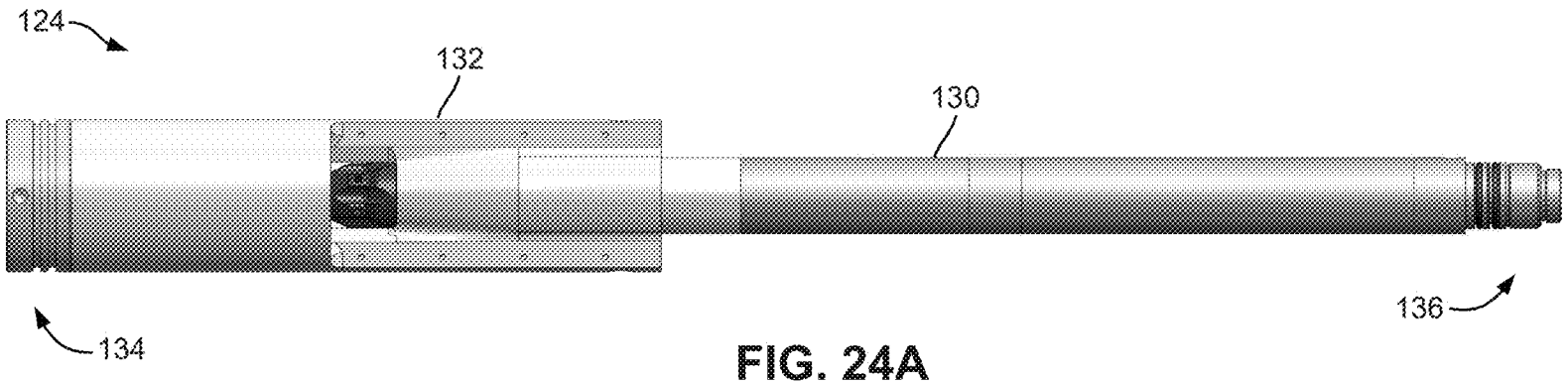
FIG. 24A is a side view of a MWD tool having the pulser assembly shown in FIG. 3A, according to some embodiments of this disclosure.
Figure 24B:
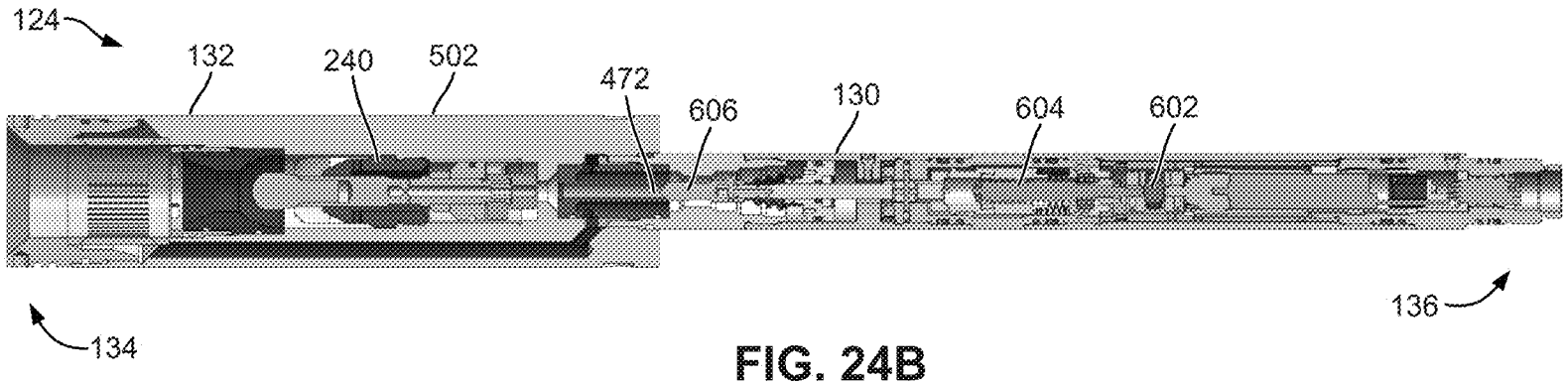
FIG. 24B is a cross-sectional view of the MWD tool shown in FIG. 24A.

FIGS. 24A and 24B show a MWD tool 124 in some embodiments. The MWD tool 124 comprises a measurement structure 130 and an above-described mud-telemetry pulser assembly 132 uphole thereto. The measurement structure 130 comprises a motor 602 coupled to a linear actuator 604 (e.g., a ball-screw or a lead-screw) for driving a pilot valve 606 to sealably engage and close the pilot port 472' (i.e., the downhole opening of the bore 472) of the pilot manifold 232, or move away from and open the pilot port 472', based on the data collected by one or more sensors (not shown), thereby creating modulated pulses from the pulser assembly 132 for communicating with the surface.

FIGS. 25 to 29B show a process of generating a pressure pulse using the MWD tool 124.

Figure 25:
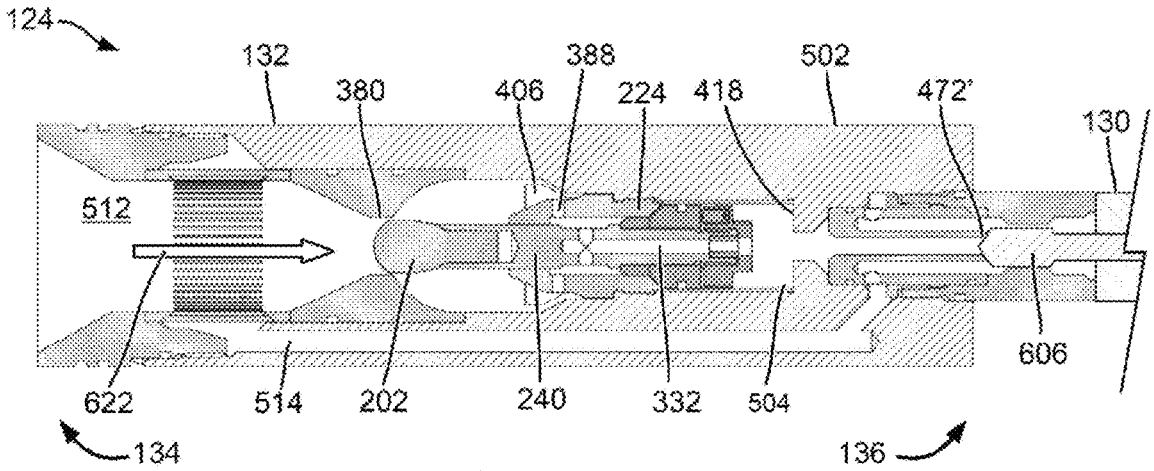

FIG. 25 shows an initial stage, in which the piston 240 is in the main-valve closed state with the poppet tip 202 thereof engaging the orifice 380 of the valve housing 502, thereby closing the main channel 512. The pilot valve 606 sealably engages and closes the pilot port 472', thereby closing the secondary channel 514.

A mud fluid flow 622 is fed from the uphole end 134 of the pulser assembly 132 and applies a pressure on the poppet tip 202 of the piston 240. As the piston chamber 504 is isolated from the fluid flow 622 at the uphole end 134 of the pulser assembly 132 (due to the closing of the secondary channel 514) and any fluid under pressure in the piston chamber 504 may be drained via the channel 332 of the piston 240 and the (draining) port 388 of the flow cone 224, the pressure in the piston chamber 504 is low. Consequently, the piston 240 is pushed downhole by the fluid flow 622.

Figure 26A:
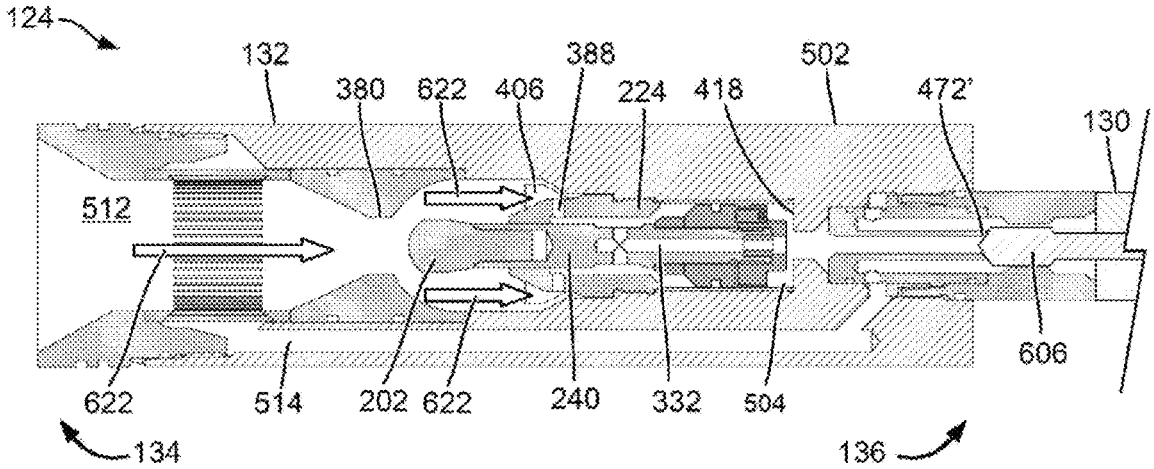
FIG. 26A is a cross-sectional view of a portion of the MWD tool shown in FIG. 24A, showing the pulser assembly shown in FIG. 3A in a first stage.

As shown in FIG. 26A, the pulser assembly 132 is in the first stage when the poppet tip 202 of the piston 240 is pushed downhole away from the orifice 380. At this stage, the piston 240 is in the main-valve open state. The fluid flow 622 passes the orifice 380 and is drained through the ports 406.

Figure 26B:
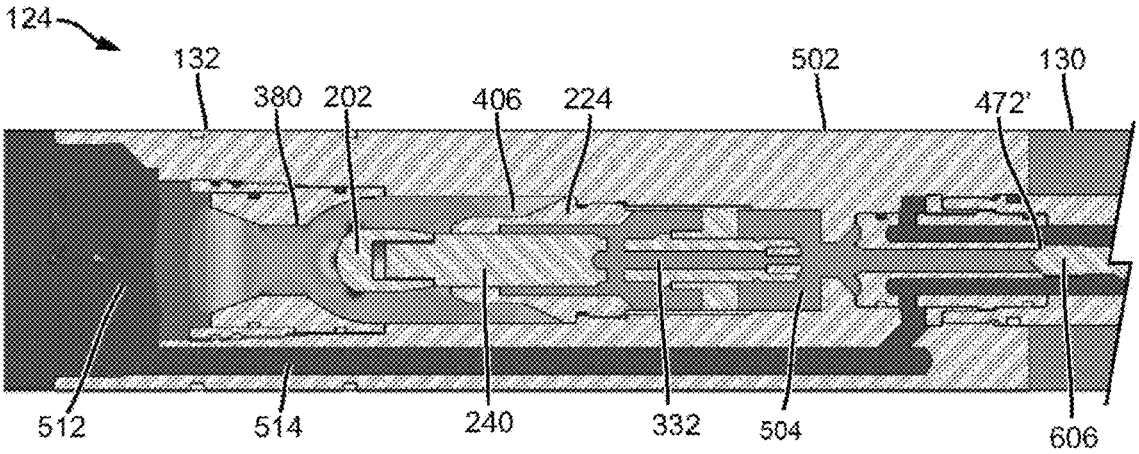
FIG. 26B illustrates the pressure distribution in the pulser assembly shown in FIG. 3A in the first stage, with darker color representing higher pressure and lighter color representing lower pressure.

FIG. 26B shows the pressure distribution in the pulser assembly 132, wherein darker color represents higher pressure and lighter color represents lower pressure. As shown, the pressures uphole and downhole to the piston 240 are maintained in a substantially balanced level (lower than the pressure above the orifice 380).

Figure 27A:
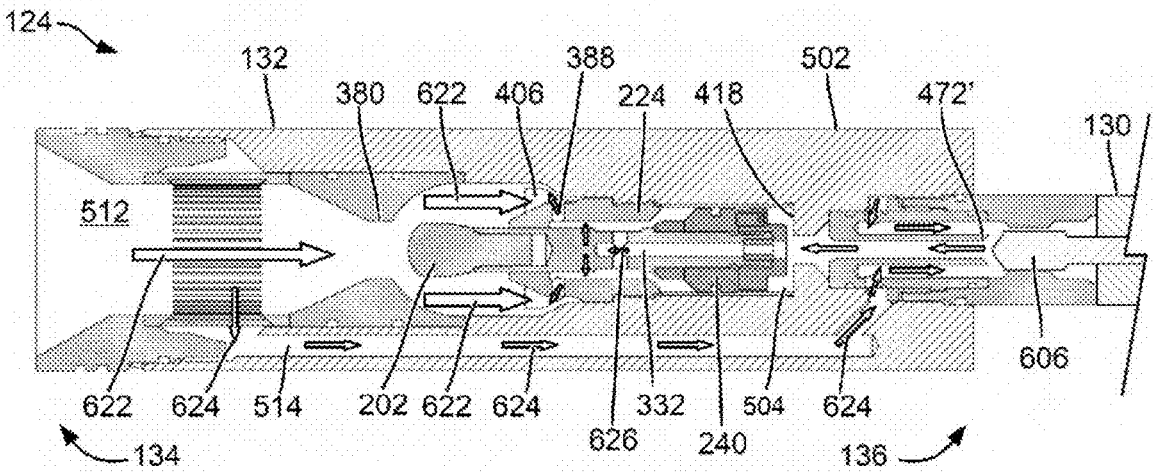
FIG. 27A is a cross-sectional view of a portion of the MWD tool shown in FIG. 23A, showing the pulser assembly shown in FIG. 3A in a second stage.
Figure 27B:
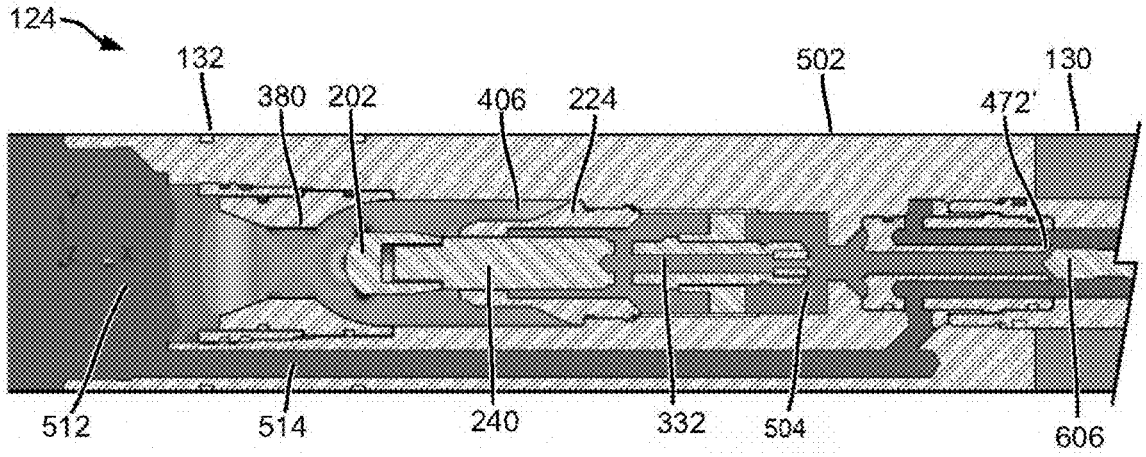
FIG. 27B illustrates the pressure distribution in the pulser assembly shown in FIG. 3A in the second stage.

As shown in FIG. 27A, in the second stage, the pilot valve 606 moves downhole away from the port 472'. The secondary channel 514 is then open. A portion of the fluid flow (identified using reference numeral 624) passes through the apertures/slots 366 of the screen 220, travels along the secondary channel 514, and enters the piston chamber 504 via the port 472'. As the piston 240 has an area at its downhole end greater than that at its uphole end, and as the main shaft orifice 212 of the piston 240 limits the fluid flow 626 into the channel 332, the pressure applied to the downhole end of the piston 240 becomes higher than that applied to the uphole end thereof, thereby actuating the piston 240 uphole. FIG. 27B shows the pressure distribution in the pulser assembly 132 at this stage.

Figure 28A:
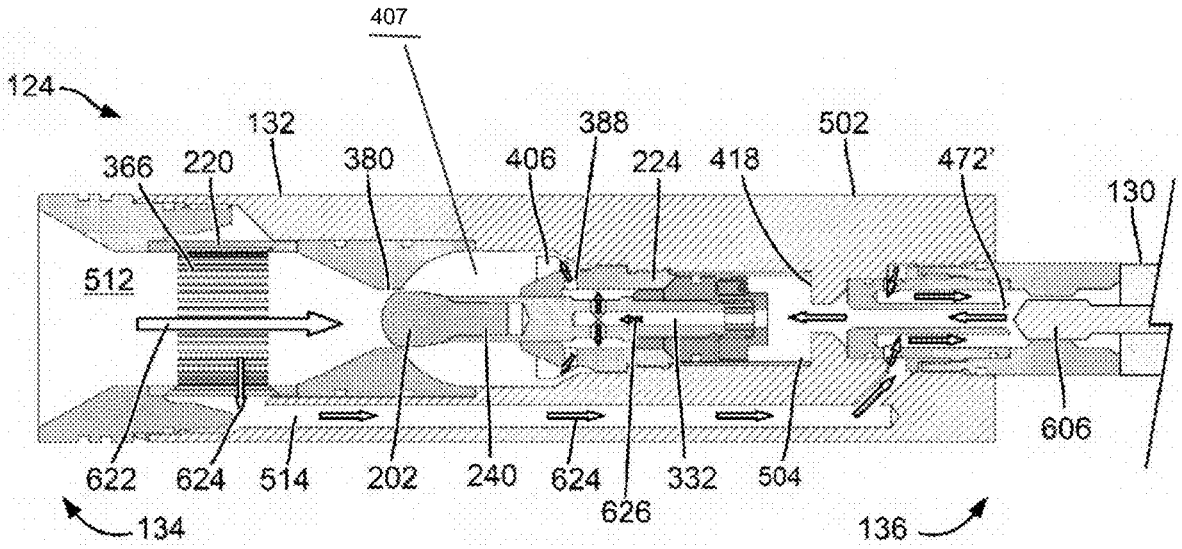
FIG. 28A is a cross-sectional view of a portion of the MWD tool shown in FIG. 24A, showing the pulser assembly shown in FIG. 3A in a third stage.
Figure 28B:
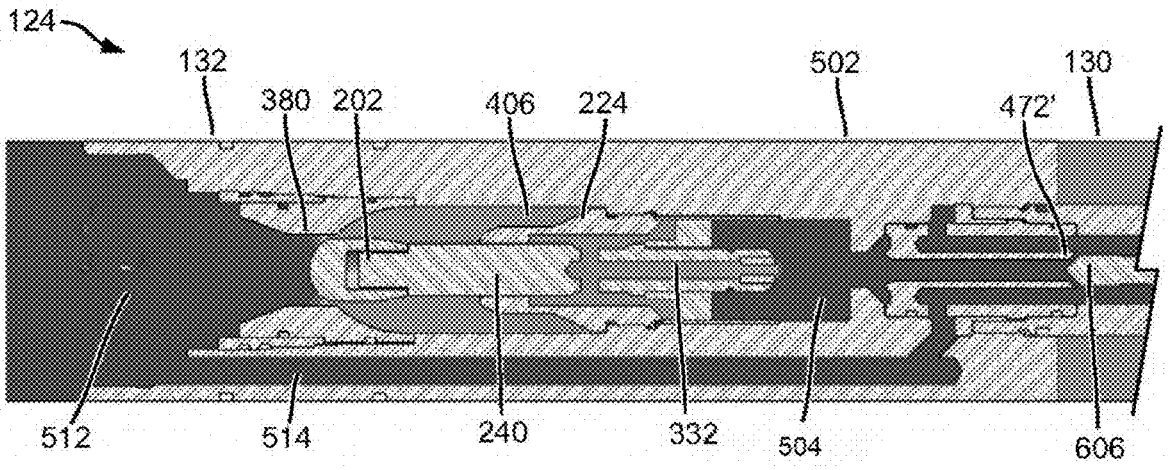
FIG. 28B illustrates the pressure distribution in the pulser assembly shown in FIG. 3A in the third stage.

Consequently and as shown in FIG. 28A, in the third stage, the piston 240 is actuated uphole to the main-valve closed state with the poppet tip 202 engaging the orifice 380 and closing the main channel 512. The secondary channel 514 is still open, allowing the fluid flow 624 to pass through the apertures/slots 366 of the screen 220, travel along the secondary channel 514, and enter the piston chamber 504 via the port 472'. A limited fluid flow 626 passes through the channel 332 and is drained from the ports 388 and 406. FIG. 27B shows the pressure distribution in the pulser assembly 132 at this stage.

Figure 29A:
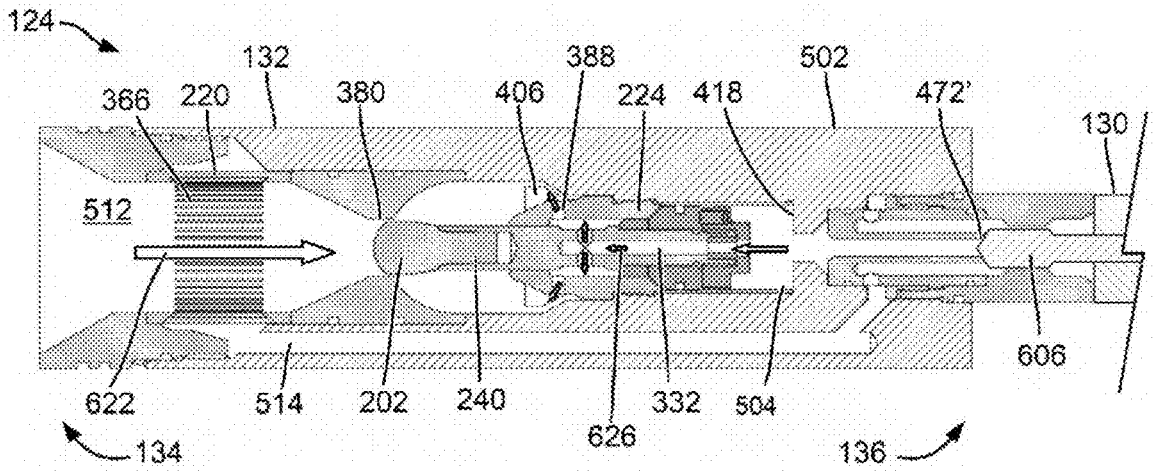
FIG. 29A is a cross-sectional view of a portion of the MWD tool shown in FIG. 23A, showing the pulser assembly shown in FIG. 3A in a fourth stage.
Figure 29B:
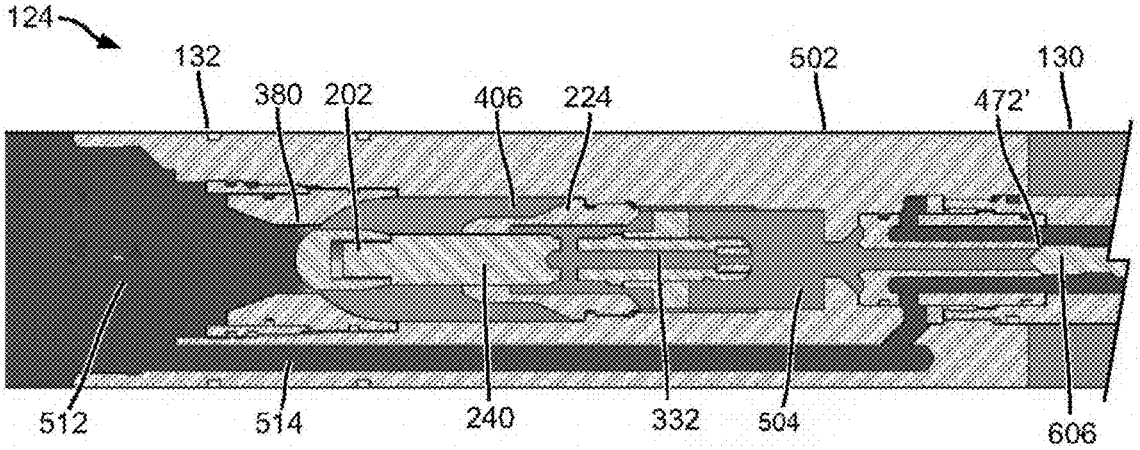

In the fourth stage as shown in FIG. 29A, the pilot valve 606 is driven uphole and engages the downhole pilot port 472'. The secondary channel 514 is then closed. The piston 240 is still at the main-valve closed state bearing the pressure from the fluid flow 622 uphole thereto. The fluid 626 in the piston chamber 504 is drained from the ports 388 and 406. Thus, this stage is the same as the initial stage shown in FIG. 25. FIG. 27B shows the pressure distribution in the pulser assembly 132 at this stage.

With the pilot valve 606 being driven to open and close the port 472', the pulser assembly 132 cycles through the above-described four stages, thereby generating modulated pressure pulses in the mud fluid for communicating with surface.

Figure 30:
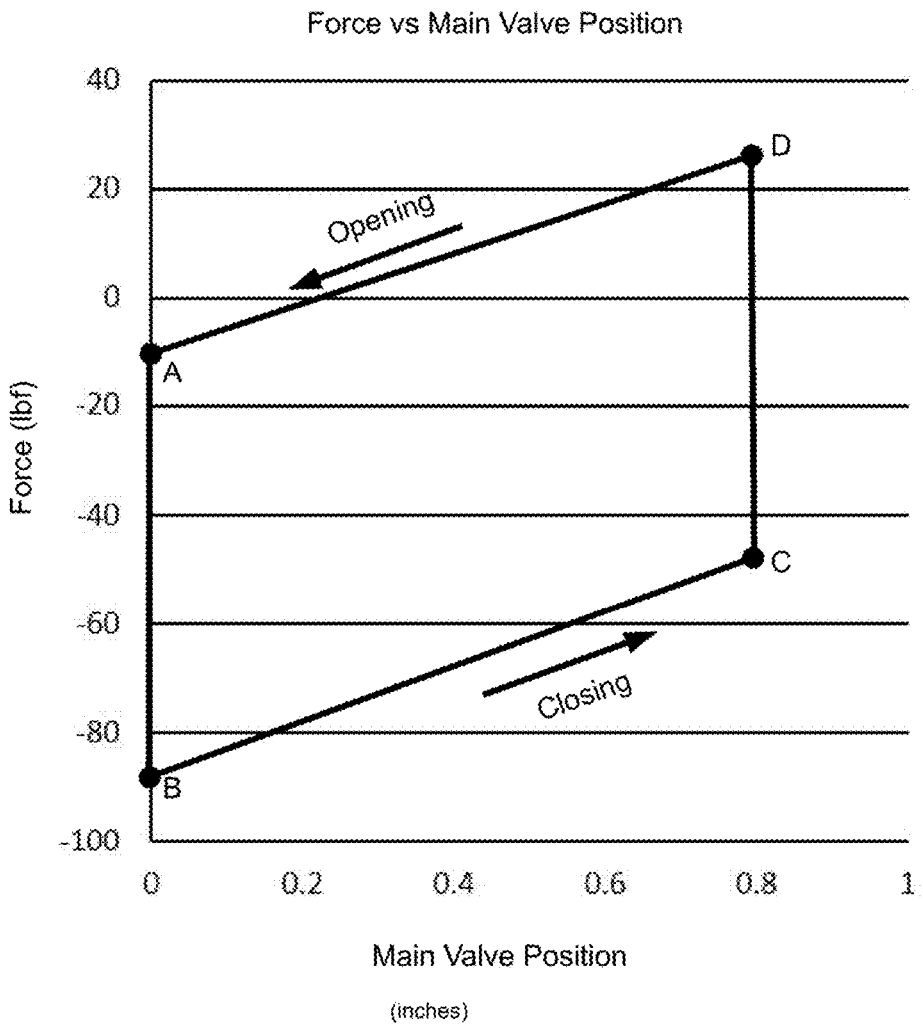
FIG. 30 is a representative graph showing the general relationship between the force exerted by fluid pressure on the moveable piston valve versus its longitudinal position in the pulser assembly shown in FIG. 3A, with position "0.8" being the position where the poppet head is covering the uphole opening in the valve assembly and the main valve is closed.

FIG. 30 shows the relationship between the pressure force and the main-valve position during the transition of the above-described four stages.

Figure 31:
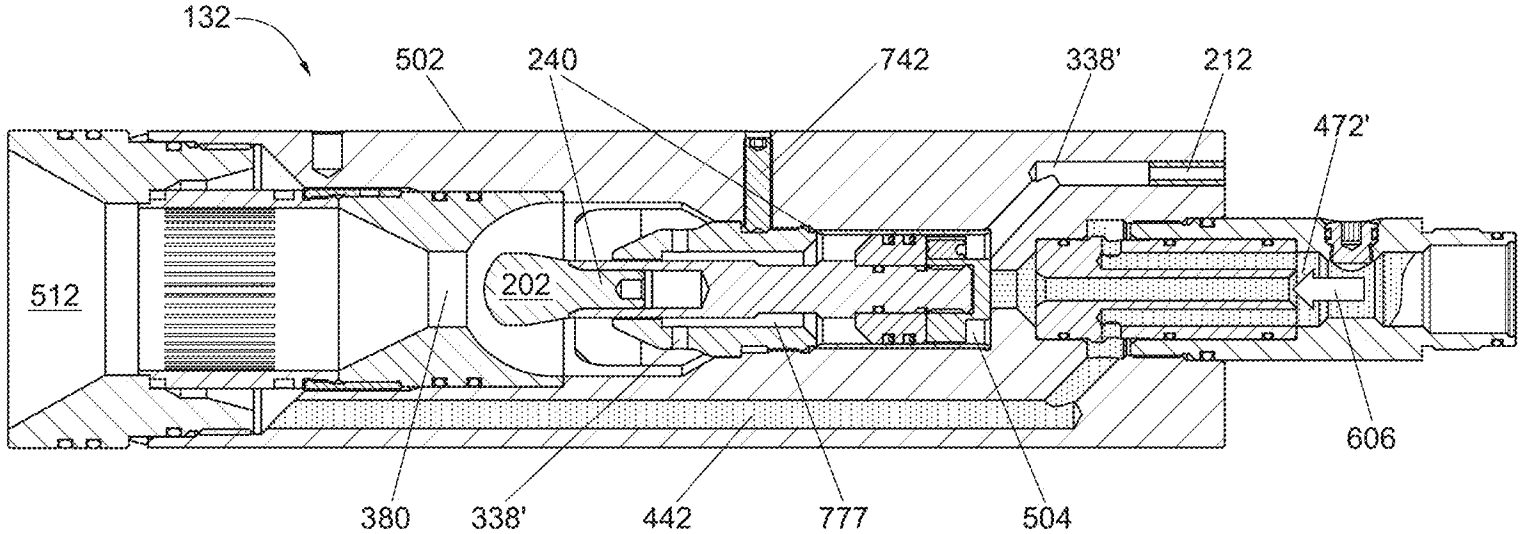
FIG. 31 is a sectional side view of another embodiment of the mud pulser of the present invention, differeing from earlier Figures in that an egress port in fluid communication with the piston chamber is provided, which egress port is further metered by a metering orifice to meter fluid flow from the piston chamber downhole, when the pilot servo-valve is closed.

FIG. 31 shows, in sectional side view of another embodiment of the mud pulser (132), differeing from the embodiment shown in FIG. 27A-29A, where instead of a passageway 332 and egress ports 388" & 256 being provided in movable piston 240, alternatively an egress port 388' in direct fluid communication with piston chamber 504 is provided within a sidewall 502 of mud pulser 132.

For this embodiment shown in FIG. 31, the downhole servo-pilot valve 606 is shown in a closed position, and due to fluid being permitted to escape piston chamber 504, the downhole piston and poppet tip 202 are forced downhole by uphole fluid pressure in region 512, thereby opening uphole opening 380.

In such embodiment shown, fluid flow through egress port 388' is further metered by metering orifice 212.

Figure 32:
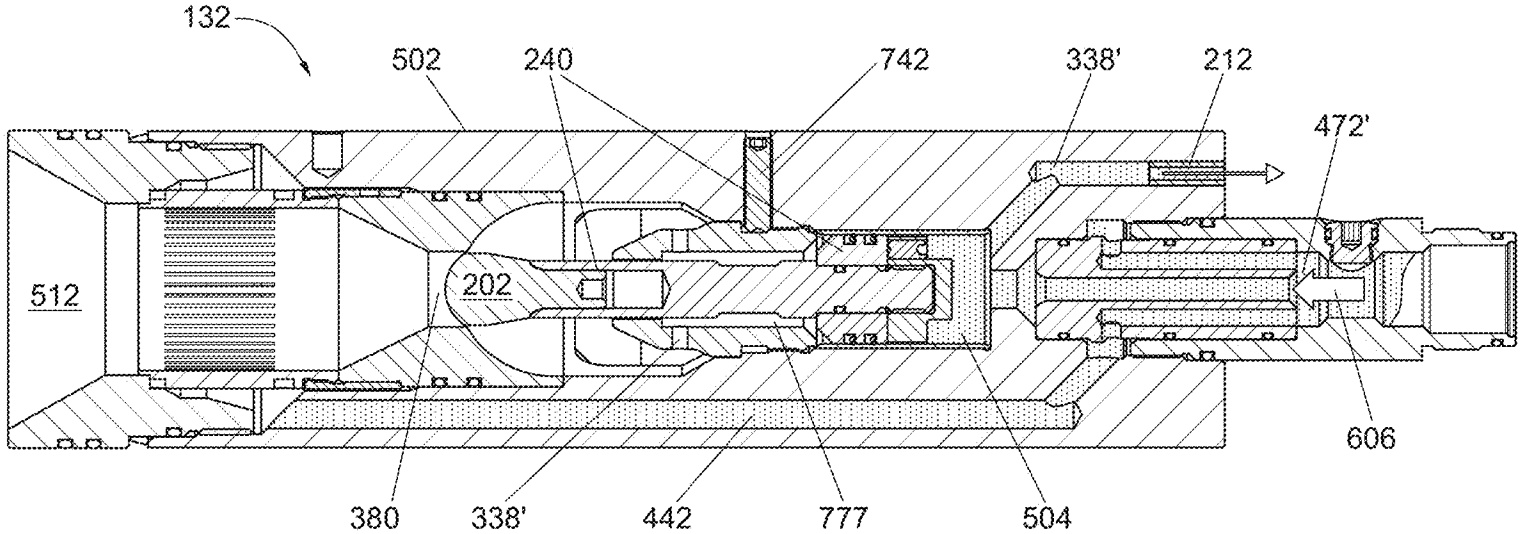
FIG. 32 is a similar view of the embodiment shown in FIG. 31, when the servo-valve is opened.
Figure 33:
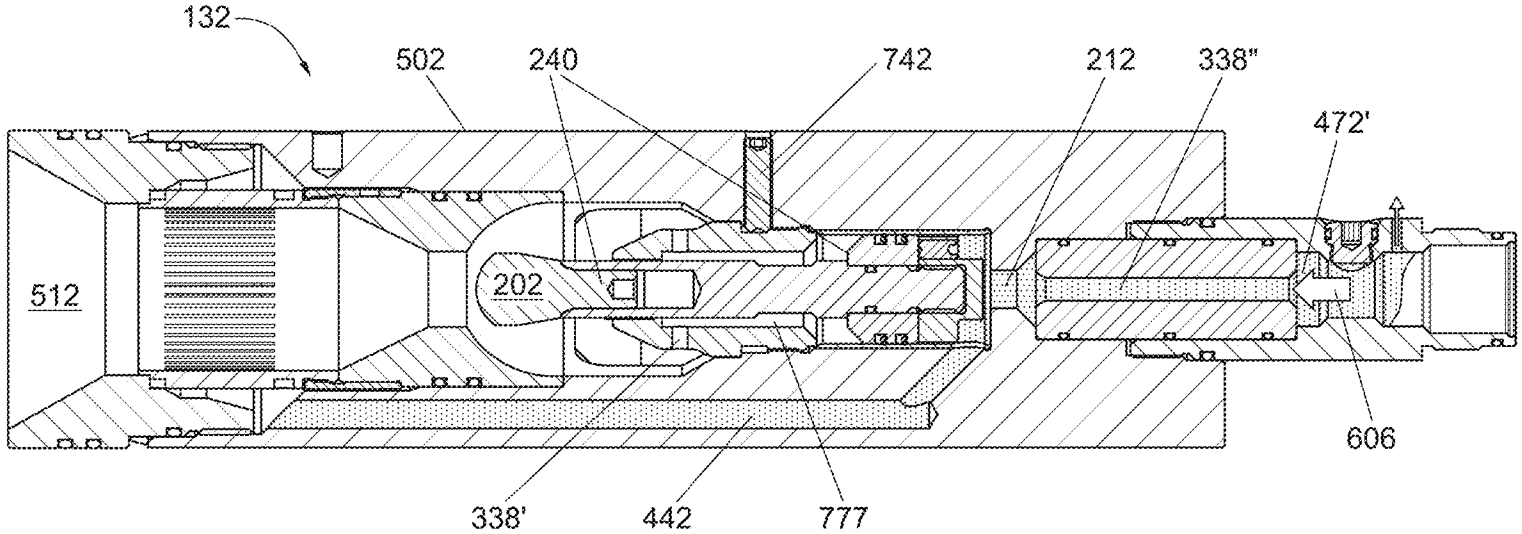
FIG. 33 is a sectional side view of another embodiment of the mud pulser of the present invention, differing from earlier Figures in the first channel directly communicates with the piston chamber, when for such configuration the downhole pilot servo-valve is open.

FIG. 32 is a similar view of the embodiment shown in FIG. 31, when the servo-valve is opened. Although fluid flow exits position chamber 504, due to metering of metering orifice 212 and the cross-sectional area of the base of moveable piston 240 being greater than the cross-sectional area of poppet tip 202, opening of servo-valve 606 causes fluid to flow into piston chamber 504 and thus moveable piston 240 to move uphole, thereby closing opening 380 and creating a pressure pulse in fluid flow 622.;

FIG. 33 is a sectional side view of another embodiment of the mud pulser of the present invention, where the first channel 442 directly communicates with the piston chamber 504. Shown is the configuration of such embodiment when the downhole pilot servo-valve 606 has opened pilot port 472', and fluid from first channel 442 has consequently been permitted to into piston chamber 504, and exit therefrom via fluid egress port 338" and out port 472'. Uphole fluid pressure in rigion 512 on poppet tip 202 has caused poppet tip 202 and moveable piston vavle 240 to move downhole, thereby opening uphole opening 380.

A metering orifice 212 may further be provided, to meter fluid flow egressing and entering piston chamber 504.

Figure 34:
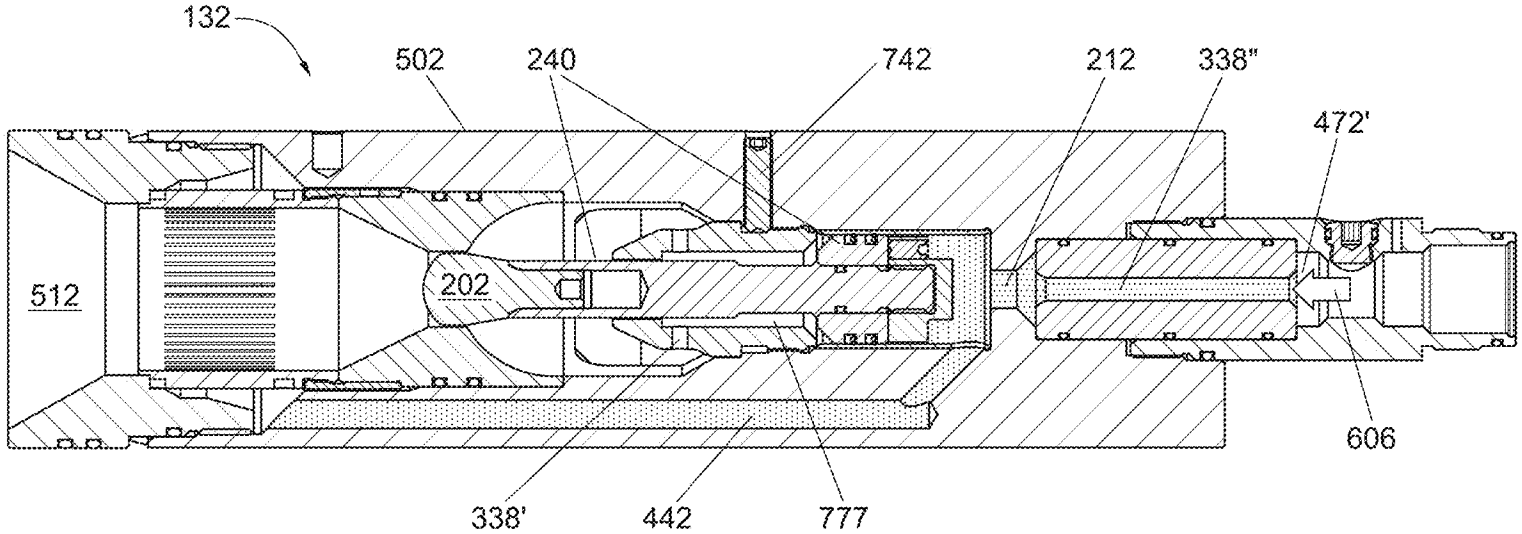
FIG. 34 is a similar view of the embodiment shown in FIG. 33, when for such configuration the downhole servo-valve is closed.

FIG. 34 is a similar view of the embodiment shown in FIG. 33, when for such configuration the downhole servo-valve 606 has been closed. Fluid within first channel 442 enters piston chamber 504, and due to the closed egress port 472' and the cross-sectional area of the base of moveable piston 240 being greater than the cross-sectional area of poppet tip 202, moveable piston valve 240 moves uphole and in the embodiment shown in FIG. 34, closes opening 380.

Figure 35:
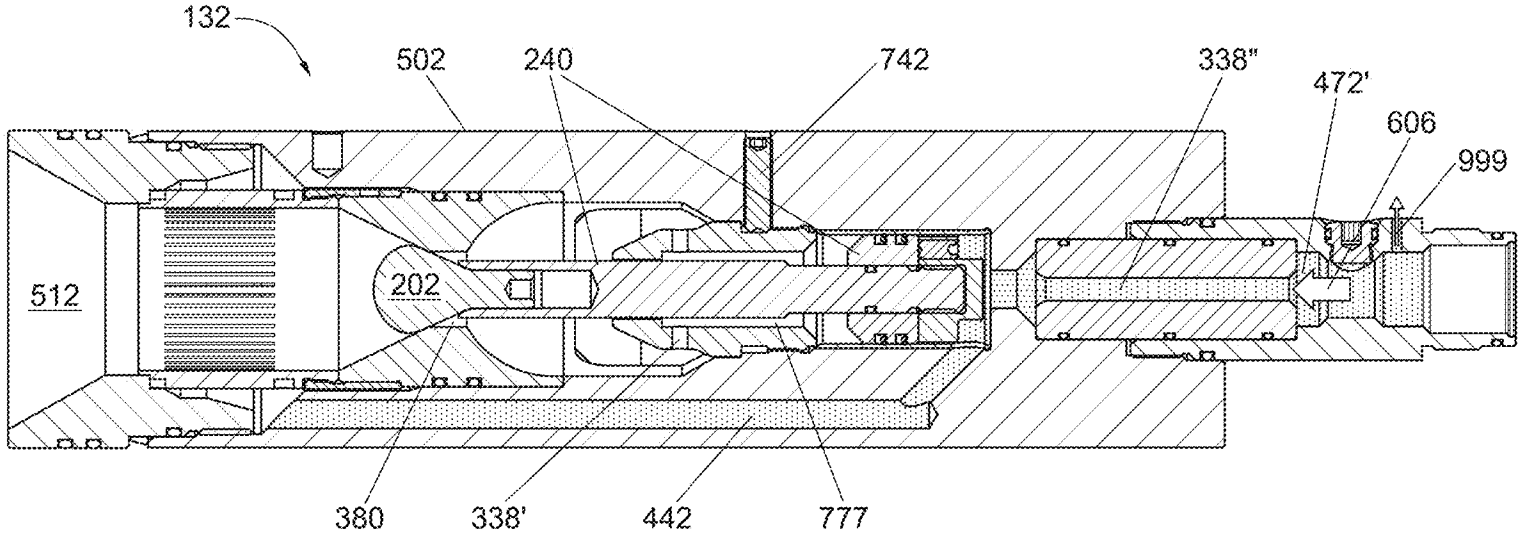
FIG. 35 is a sectional side view of another embodiment of the mud pulser of the present invention, differing from the embodiment shown in FIGS. 33 and 34 whereby the main valve is in the closed position when the downhole servo-valve is in the open position.

FIG. 35 is a sectional side view of another embodiment of the mud pulser of the present invention, differing from the embodiment shown in FIGS. 33 and 34 whereby the main valve (uphole opening 380 and associated poppet tip 202) is in the closed position covering uphole opening 380 when the downhole servo-valve 606 is in the open position uncovering pilot port 472". In the configuration shown, fluid exits pilot port 472', and may exit downhole of the mud pulser via a port 999 (see FIG. 41B).

Figure 36:
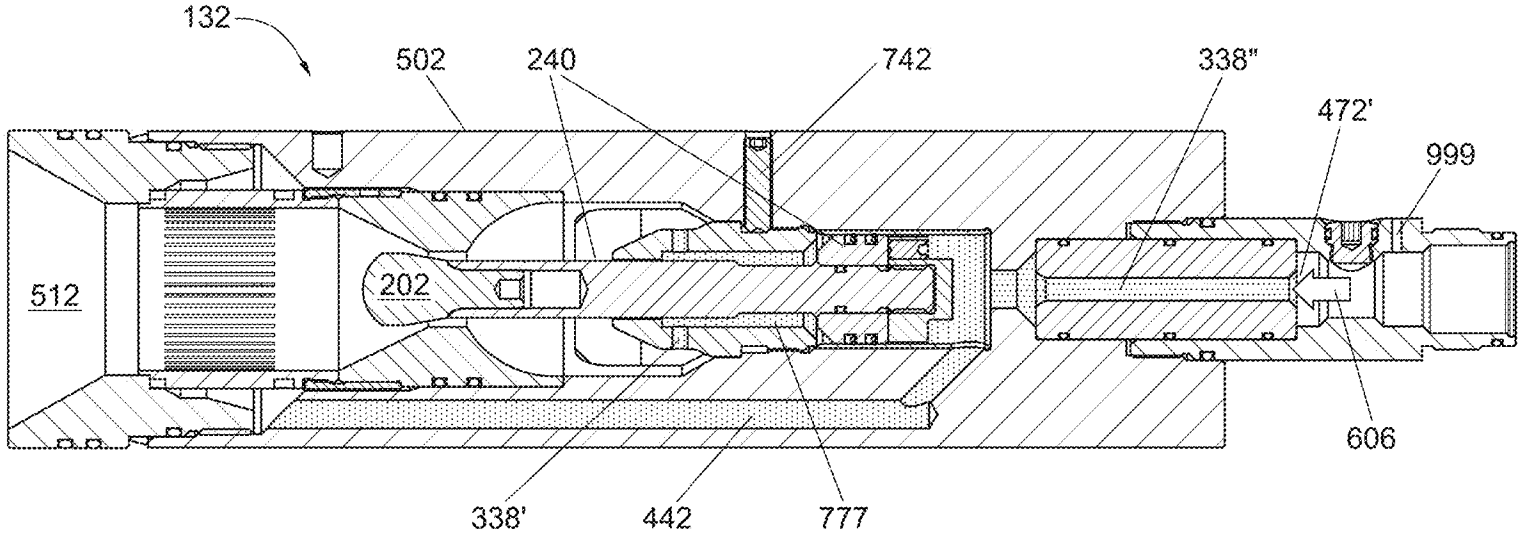
FIG. 36 is a similar view of the embodiment shown in FIG. 35, when for such configuration the downhole servo-valve is closed.

FIG. 36 is a similar view of the embodiment shown in FIG. 35, when for such configuration the downhole servo-valve 472' is closed by servo-valve 606 and fluid from first channel 442 enters piston chamber 504. Moveable piston 240 has thus been caused to move uphole and poppet tip 202 thereon caused to uncover uphole opening 380.

FIG. 37 is a sectional side perspective view of the embodiment shown in FIG. 28A, when the downhole pilot servo-valve 606 is open, showing the flow of fluid which effectuates closing of the main valve (poppet tip 202 in uphole opening 380), where egress ports are located in the movable piston valve 240.

FIG. 38 is a sectional side perspective view of the embodiment shown in FIG. 32, when the downhole pilot servo-valve port 606 is open, showing the flow of fluid which effectuates closing of the main valve (poppet tip 202 and uphole opening 380) where an egress port 388' and metering orifice 212 is located in the sidewall 502 of the mud pulser 132, and fluidly connects the piston chamber 504 with a region downhole of the mud pulser 132.

Figure 39:
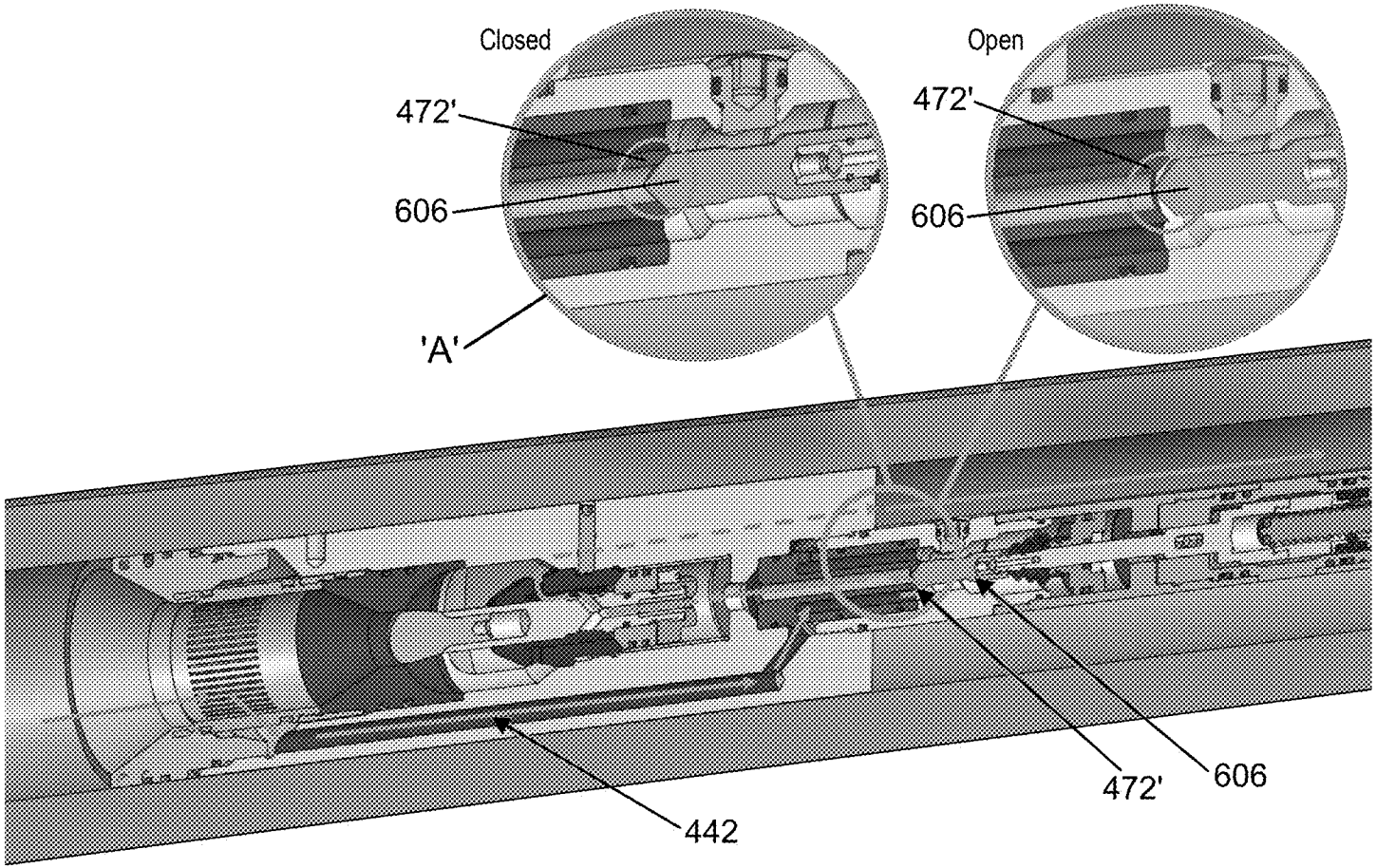
FIG. 39 is a sectional side perspective view of the embodiment shown in FIG. 28A, when the downhole pilot servo-valve is open, showing the flow of fluid which effectuates closing of the main valve, where egress ports are located in the movable piston valve, further showing greater details of the downhole pilot servo-valve.

FIG. 39 is a sectional side perspective view of the embodiment shown in FIG. 28A, when the downhole pilot port 472' is uncovered by servo-valve 606 and thus open, showing the flow of fluid which effectuates closing of the main valve (poppet tip 202 and uphole opening 380), where egress ports are located in the movable piston valve 240, further showing greater details of the downhole pilot servo-valve 606. Enlarged view 'A' shows an alternative position of the servo-valve 606 when covering (and thus closing) the pilot port 472'

Figure 40A:
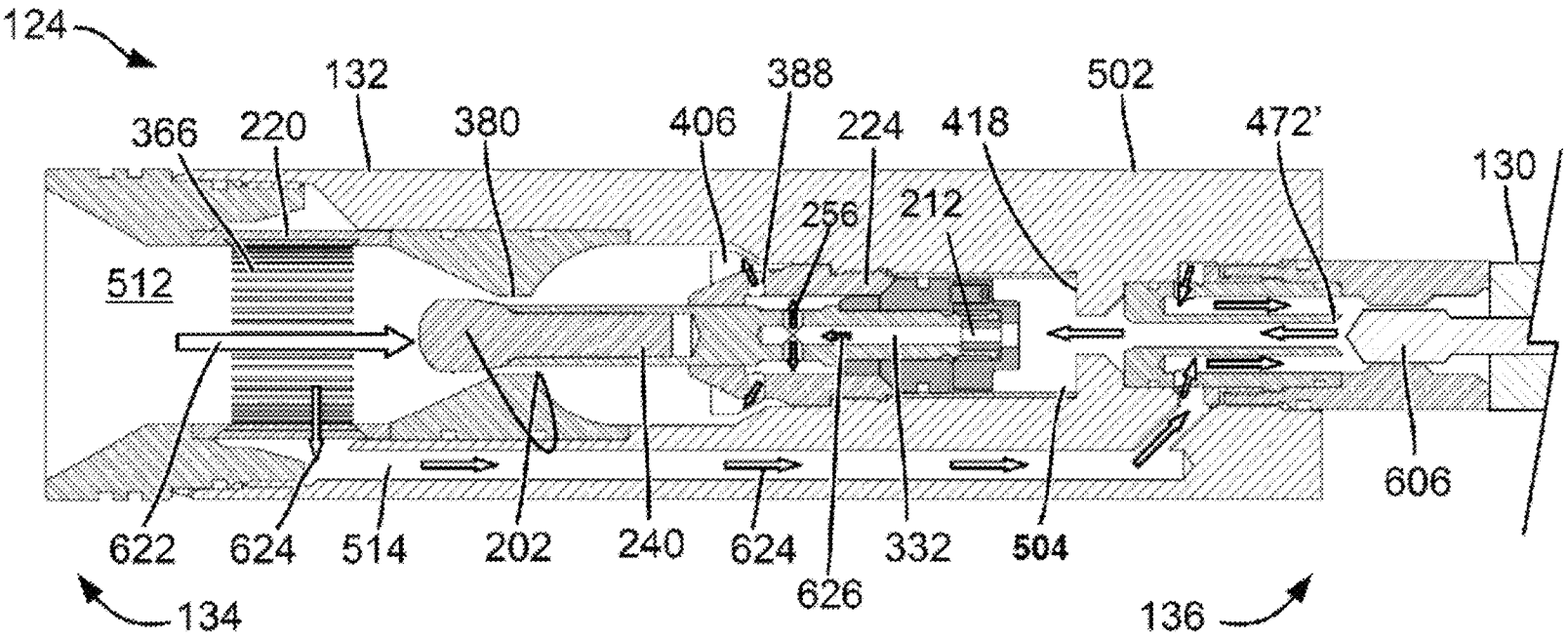
FIG. 40A is a sectional side perspective view of an alternative embodiment to the embodiment shown in FIG. 28A, when the downhole pilot servo-valve is open, showing the flow of fluid which in such alternative embodiment effectuates the opening of the main valve.

FIG. 40A is a sectional side perspective view of an alternative embodiment to the embodiment shown in FIG. 28A, when the downhole pilot servo-valve 606 is open, showing an configuration (embodiment) where the flow of fluid in such alternative embodiment effectuates the opening of the main valve (poppet tip 202 and uphole opening 380).

Figure 40B:
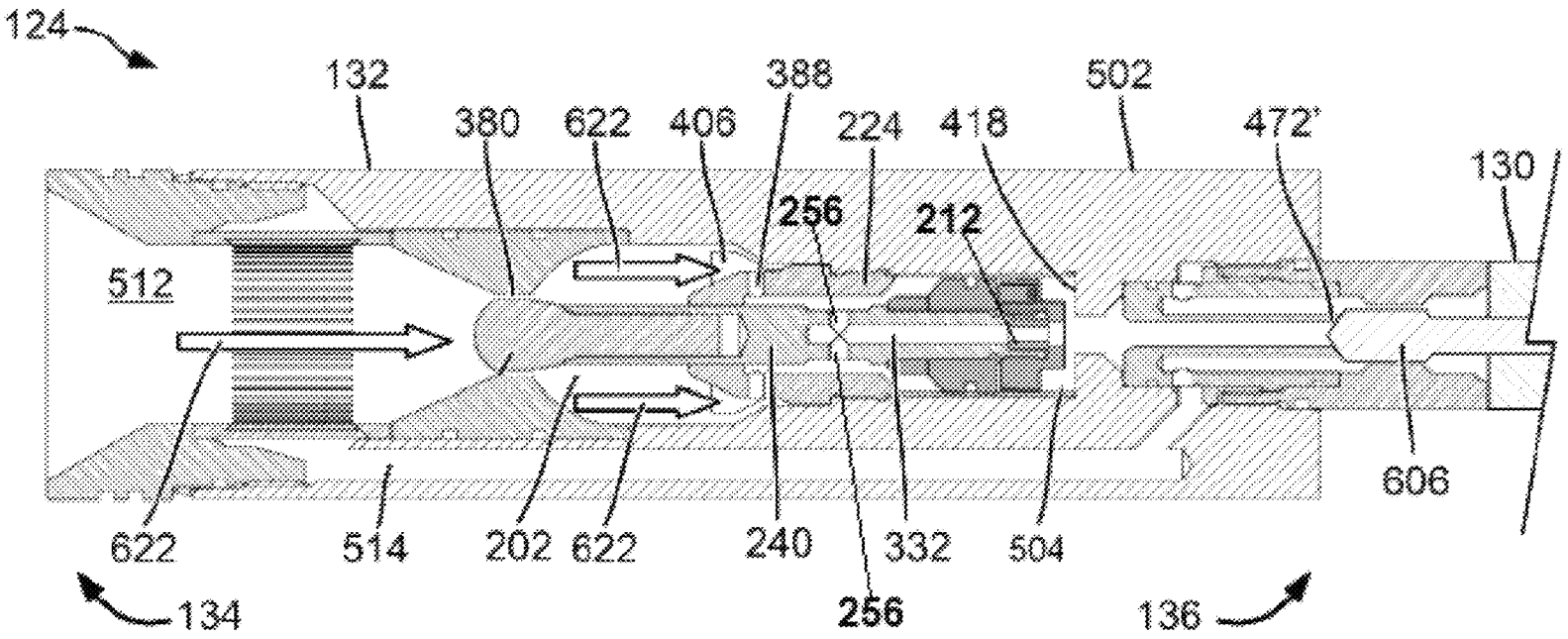
FIG. 40B is a similar view of the embodiment shown in FIG. 40A when the downhole pilot servo-valve is closed, showing the flow of fluid which in such alternative embodiment effectuates closing of the main valve.

FIG. 40B is a similar view of the embodiment shown in FIG. 40A when the downhole pilot servo-valve 472' is closed by servo-vavle 606, showing the flow of fluid which in such alternative embodiment effectuates closing of the main valve (poppet tip 202 and uphole opening 380).

As shown in each of FIGS. 40A, 40B, a metering orifice 212 may be provided in passageway 332.

The purpose of the metering orifice 212, which restricts somewhat the fluid flow through passageway 332, is to allow some fluid pressure to exist in piston chamber 504 when downhole servo-valve 606 is open as shown in FIG. 40A, such that the product of the cross-sectional area of the moveable piston 240 at its base multiplied by the fluid pressure in piston chamber 504 due to the restriction caused by metering orifice 212 restricting flow of such fluid exiting pistion chamber 504 via fluid egress ports 256 and 388 is greater than the product of the uphole fluid pressure in region 512 multiplied by the cross-sectional area of poppet tip 202. If such condition exists when servo-valve 606 closes downhole port 472', then poppet tip 202 in the desired scenario of FIG. 40A will be forced uphole.

Otherwise, in absence of such metering orifice 212, it is potentially possible the fluid pressure in piston chamber 504 may not be sufficient to force moveable piston 504 uphole, resulting in the desired opening of the main valve in region 380 and as shown in FIG. 40A, not being obtainable, and no pressure pulse thus be able to be generated.

Figure 41A:
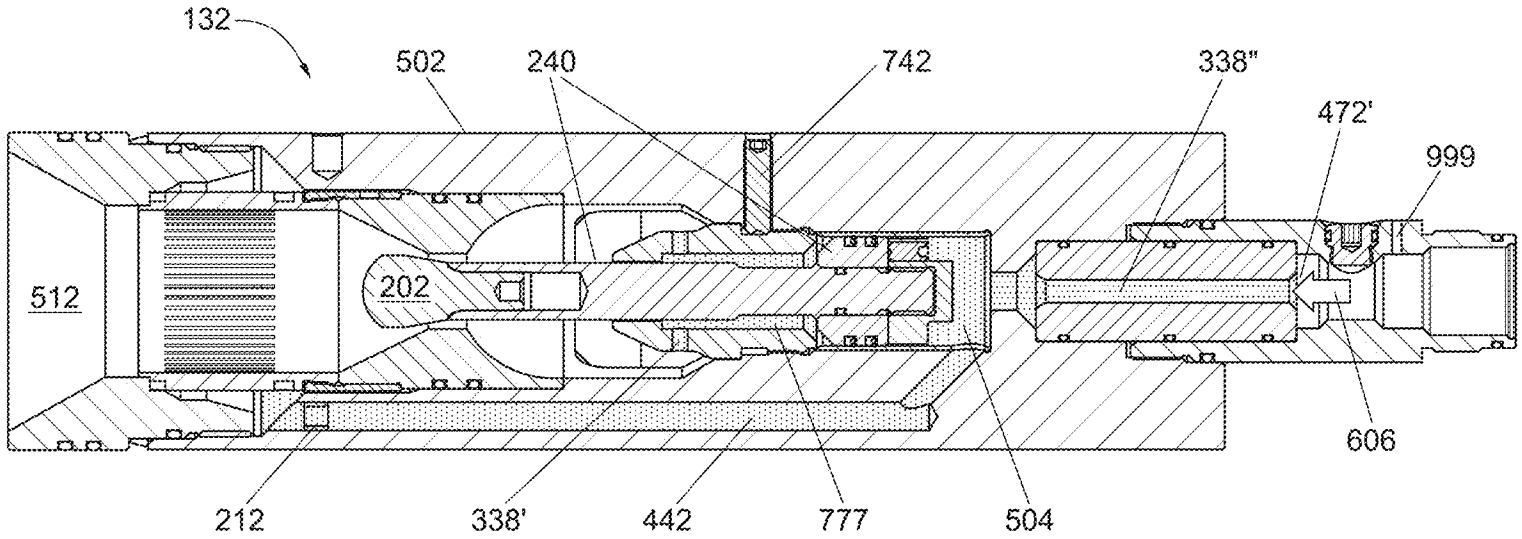
FIG. 41A is a sectional side perspective view of an alternative embodiment similar to the embodiment shown in FIG. 36, but having a metering orifice in the first channel in the sidewall of the valve housing, when the downhole pilot valve port is open and the main valve is closed.
Figure 41B:
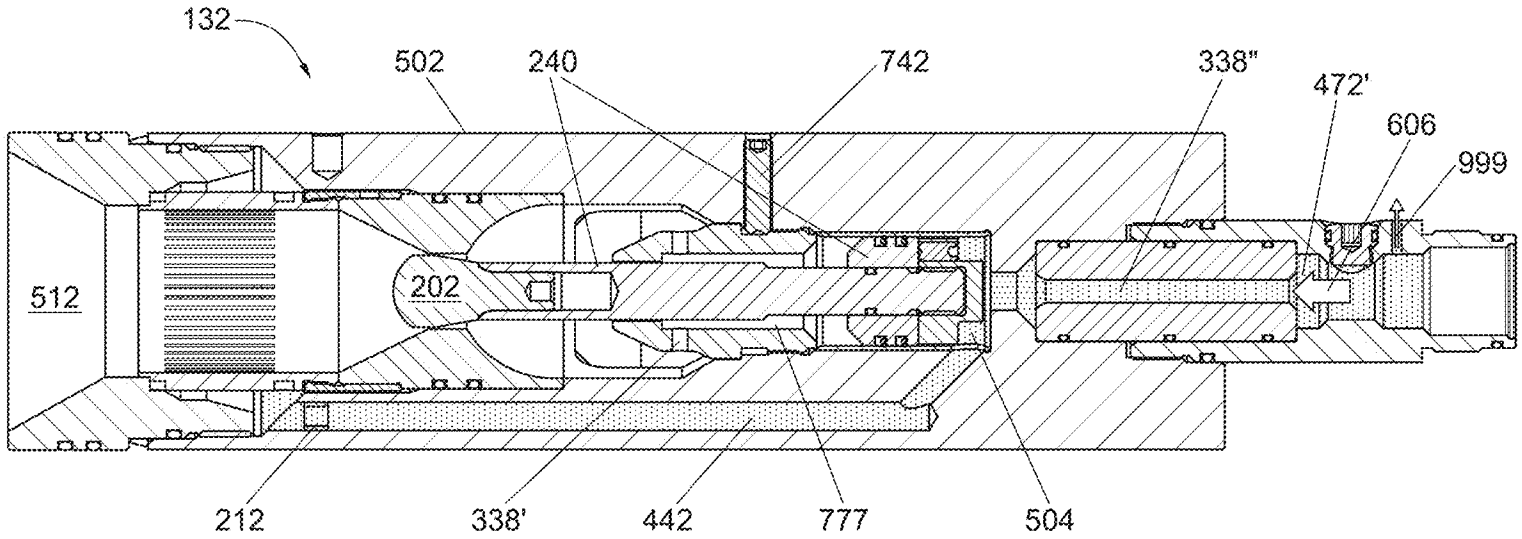
FIG. 41B is a similar view of the embodiment shown in FIG. 41A when the downhole pilot servo-valve is closed, showing the flow of fluid which in such alternative embodiment effectuates closing of the main valve

Equally effectively, a metering orifice in the embodiments shown in FIG. 40A, 40B could instead be provided in fluid egress ports 256 and/or 388, which would achieve the same effect as locating such metering port in passageway 332, namely to restrict the fluid flow egressing piston chamber 504 to a degree, to allow some pressure As shown in each of FIGS. 41A, 41B, namely in the embodiment of the invention where the first channel 442 is, line in FIGS. 35 *a* & 36, in direct communication with piston chamber 504, a metering orifice 212 may likewise be provided. However, in this embodiment, metering orifice 212 is instead provided in first channel 442, as shown.

FIG. 41A is a sectional side perspective view of an alternative embodiment similar to the embodiment shown in FIG. 36, namely the embodiment where a first channel (442) is situated within said valve housing (502), in fluid communication with a first region (512) of the mud pulser (132) uphole of said uphole opening (380) and longitudinally extending downhole in a sidewall of said valve housing (502). The embodiment shown is an embodiment where first channel 442 fluidly connects the first region (512) with piston chamber (504), as per the embodiments shown in FIGS. 33, 34, 35, 36 & FIGS. 41A, 41B. In this embodiment, however, a metering orifice 212 is situated in first channel 442.

When the downhole servo-valve 606 closes downhole servo-port 472', fluid pressure in first channel 442 forces moveable piston 240 uphole, thereby, in this embodiment, positioning poppet tip 202 in a manner to open the main valve by opening uphole opening 380.

When downhole servo-valve 606 closes downhole servo-port 472' as shown in FIG. 41B, fluid in piston chamber 504, even though flowing into such piston chamber 504, flow out of piston chamber 504 and when downhole of vervo-valve 606, exists via port 999.

Thus in the embodiment shown in FIGS. 41A, 41B, metering orifice 212 restricts the fluid flow through first channel 442 to an extent and to an amount when servo valve 606 is closed (as shown in FIG. 41A) such that the pressure in piston chamber 504 multiplied by the cross-sectional area of moveable piston 240 in the base thereof is GREATER than the product of the uphole fluid pressure in region 512 multiplied by the cross-sectional area of poppet tip 202. Thus when servo-vavle 606 opens, the moveable piston valve 240 may nevertheless be forced closed, as shown in FIG. 41B.

In the absence of metering orifice 212 in FIG. 41B, (ie. the closed position of uphole opening 380), such as in the configuration shown for example in FIG. 35, 36, the pressure drop in first channel 442 or the pressure drop downhole when fluid egresses port 999, due to the diameter and lengths of first channel 442 and/or downhole egress port 999 and their respective geometry, may not be sufficient, and in such circumstances main valve (poppet 202 and uphole opening 380) could potentially remain permanently in the open position due to fluid pressure supplied from area 512 via first channel 442, thereby preventing mud pulser 132 to generate pressure pulses by opening and closing such main valve.

The ability of the present design to incorporate a metering orifice 212 of a given diameter advantageously hereby provides a customized restriction in the fluid pressure being either supplied to the piston chamber 504 (eg. FIG. 41A, 41B) or being allowed to egress piston chamber 504 (eg. FIG. 31, 32 or FIG. 40A, 40B), and thus allows mud pulsers of the present design to be customized for various fluid pressures which may be experienced downhole and for various sizes of first channels 442 and/or fluid egress ports 256, 388, 999 which may be utilized.

Although embodiments have been described above with reference to the accompanying drawings, those of skill in the art will appreciate that variations and modifications may be made without departing from the scope thereof as defined by the appended claims.

What is claimed is:

1. A mud pulser for generating pressure pulses in a fluid flow in a wellbore, adapted for mounting downhole in a wellbore immediately uphole of a servo-valve and to be controlled by said servo-valve, the mud pulser comprising:

a valve housing, having an uphole opening therein for receiving at least a portion of the fluid flow passing through said mud pulser;

a downhole pilot port adapted to receive and be opened and closed by said downhole servo-valve;

a piston chamber on a downhole side of said uphole opening and uphole of said downhole pilot port, wherein said downhole pilot port is in fluid communication with said piston chamber when said servo-pilot valve opens said downhole pilot port;

a moveable piston valve moveable within said piston chamber and having a poppet tip on an uphole end thereof for opening and closing said uphole opening, wherein a cross-sectional area of said piston valve in said piston chamber is greater than a cross-sectional area of said poppet tip;

one or more fluid egress ports in fluid communication with said piston chamber;

said poppet tip on said piston valve forming with said uphole opening a main valve for regulating said at least a portion of said fluid flow and moveable between a main-valve open position uncovering said uphole opening and a main-valve closed position covering or closing said uphole opening, said movement of said piston valve and poppet tip causing the pressure pulses in said fluid flow; and a first channel within said valve housing, in fluid communication with a first region of said mud pulser uphole of said uphole opening and longitudinally extending downhole in a sidewall of said valve housing, (i) fluidly connecting, when said downhole pilot port is opened by said downhole pilot valve, said piston chamber with said first region; or (ii) fluidly connecting said first region with said piston chamber.

2. The mud pulser as claimed in claim 1, wherein:

(i) the first channel fluidly connects said first region with said piston chamber; and (ii) the downhole pilot port is adapted, when opened by said downhole servo-pilot valve, to allow pressurized fluid from said first channel to flow out of said piston chamber and thereby allow the piston valve and poppet tip to move downhole thereby opening or closing said uphole opening, and when said downhole pilot port is closed, to allow fluid pressure uphole of said uphole opening and flowing into said piston chamber via said first channel to cause said piston valve and the poppet head thereon to move uphole to thereby respectively close or open said uphole opening.

3. The mud pulser as claimed in claim 2, wherein said first channel contains a metering orifice through which fluid passing through said first channel must pass when said fluid is entering said piston chamber, wherein said metering orifice has a bore therein of a selected diameter for limiting said fluid flow therethrough.

4. The mud pulser as claimed in claim 1, wherein the valve housing further comprises a screen member for assisting in preventing unwanted detritus and/or unwanted circulated drilling remnants from passing from said first region into said first channel.

5. The mud pulser as claimed in claim 4, wherein:

(i) the screen member comprises a bore with a plurality of apertures or slots on a periphery thereof for filtering debris in the fluid flow; and (ii) (ii) the first channel is in fluid communication with said first region uphole of the uphole opening via said plurality of apertures or slots on screen member.

6. The mud pulser as claimed in claim 1, wherein said one or more fluid egress ports comprises a single passageway situated in said moveable piston valve, wherein said passageway is in fluid communication with both the piston chamber and directly or indirectly, a second region downhole of said uphole opening.

7. The mud pulser as claimed in claim 6, wherein said passageway is further in communication with one or more of said one or more fluid egress ports.

8. The mud pulser as claimed in claim 1, wherein at least one of said or one or more fluid egress ports contains a metering orifice through which fluid passing through said at least one of said one or more fluid egress ports must pass when said fluid is egressing from said piston chamber.

9. The mud pulser as claimed in claim 8, and wherein said metering orifice is of a selected diameter for limiting said fluid flow therethrough.

10. The mud pulser as claimed in claim 1, wherein:

said one or more fluid egress ports comprises a single passageway situated in said moveable piston valve, wherein said passageway is in fluid communication with both the piston chamber and directly or indirectly, a second region downhole of said uphole opening; and said passageway is further in communication with one or more of said one or more fluid egress ports.

11. The mud pulser as claimed in claim 10, wherein at least one of said or one or more fluid egress ports contains a metering orifice through which fluid passing through said at least one of said one or more fluid egress ports must pass when said fluid is egressing from said piston chamber.

12. The mud pulser as claimed in claim 1, wherein:

(i) the first channel fluidly connects, when said downhole pilot port is opened by said downhole pilot valve, said first region with said piston chamber; and (ii) the downhole pilot port, when opened by said downhole servo-pilot valve, allows pressurized fluid from said first channel to flow into said piston chamber and move the piston valve and poppet head uphole to the main-valve closed position thereby closing said uphole opening, and when said downhole pilot port is closed, allows fluid pressure uphole of said uphole opening to cause said piston valve and the poppet head thereon to move downhole to the main-valve open position wherein said uphole opening is uncovered.

13. The mud pulser as claimed in claim 1, wherein:

said first channel fluidly connects, when said downhole pilot port is opened by said downhole pilot valve, said piston chamber with said first region;

said one or more fluid egress ports comprises a flow line in communication with said piston chamber and said downhole pilot port; and the extent, and when, said fluid is allowed to egress said piston chamber is regulated at least in part by said downhole servo-valve opening and closing said downhole pilot port.

14. The mud pulser as claimed in claim 1, wherein:

(i) the first channel fluidly connects, when said downhole pilot port is opened by said downhole pilot valve, said first region with said piston chamber; and (ii) the downhole pilot port, when opened by said downhole servo-pilot valve, allows pressurized fluid from said first channel to flow into said piston chamber and move the piston valve and poppet tip uphole to the main-valve open position thereby opening said uphole opening, and when said downhole pilot port is closed, allows fluid pressure uphole of said uphole opening to cause said piston valve and the poppet tip thereon to move downhole to the main-valve closed position wherein said uphole opening is covered.

15. The mud pulser as claimed in claim 1, further having: a passageway (332) in fluid communication with the piston chamber (504) and a metering orifice (212), which is further in fluid communication with said one or more fluid egress ports (388, 256).

16. The mud pulser as claimed in claim 1, further having: a passageway (388') in fluid communication with the piston chamber (504) and a metering orifice (212).

* * * * *